US011280571B2

(12) United States Patent
Miller et al.

(10) Patent No.: US 11,280,571 B2
(45) Date of Patent: Mar. 22, 2022

(54) INTEGRATED FLASH HIDER FOR SMALL ARMS SUPPRESSORS

(71) Applicant: Sig Sauer, Inc., Newington, NH (US)

(72) Inventors: Evan Miller, Exeter, NH (US); Krzysztof J. Kras, Fremont, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 16/953,853

(22) Filed: Nov. 20, 2020

(65) Prior Publication Data

US 2021/0190451 A1 Jun. 24, 2021

Related U.S. Application Data

(60) Provisional application No. 62/952,737, filed on Dec. 23, 2019.

(51) Int. Cl.
*F41A 21/34* (2006.01)
*F41A 21/30* (2006.01)

(52) U.S. Cl.
CPC ..... *F41A 21/34* (2013.01); *F41A 21/30* (2013.01)

(58) Field of Classification Search
CPC ..... F41A 21/30; F41A 21/34; F41A 21/36
See application file for complete search history.

(56) References Cited

U.S. PATENT DOCUMENTS 1,000,702 A 8/1911 Thurler
1,341,363 A 5/1920 Fiala
1,427,802 A 9/1922 Goodwin
1,462,158 A 7/1923 Wildner
1,736,319 A 11/1929 Maxim
(Continued)

FOREIGN PATENT DOCUMENTS

EP 1764577 3/2007
GB 743111 1/1956
(Continued)

OTHER PUBLICATIONS

Volk, Oleg, AllOutdoor.com, "Thermal Defense Solutions: 3D-Printed Inconel Sound Suppresors" available at https://www.alloutdoor.com/2018/04/03/thermal-defense-solutions-3d-printed-steel-sound-suppressors/ (Apr. 3, 2018).
(Continued)

*Primary Examiner* — Joshua T Semick
(74) *Attorney, Agent, or Firm* — Finch & Maloney PLLC

(57) ABSTRACT

A flash hider is configured to reduce a firearm's visible signature. The flash hider extends along a central axis from a proximal end to a distal end. The proximal end defines a central opening to an expanding central volume of a first flash hider portion. One or more outer volumes are located radially outside of the central volume and can be part of first and/or second flash hider portions. When the outer volumes are part of the first flash hider portion, the outer volumes can communicate with the central volume. Optionally, a second flash hider portion includes one or more gas passageways located radially outside of the central volume. For example, gas passageways are interspersed circumferentially with outer volumes of the first flash hider portion, where the gas passageways are isolated from first flash hider portion and receive gas flows via vent openings in the outer wall.

18 Claims, 13 Drawing Sheets

(56) References Cited

U.S. PATENT DOCUMENTS 1,773,443 A 8/1930 Wilman
2,101,849 A * 12/1937 Green ..... F41A 21/34 89/14.5
2,150,161 A * 3/1939 Green ..... F41A 21/36 89/14.3
2,165,457 A * 7/1939 Cutts, Jr. ..... F41A 21/36 89/14.3
2,351,037 A * 6/1944 Green ..... F41A 21/34 89/14.5
2,468,926 A 12/1944 Garrett
2,514,996 A 7/1950 Faust, Jr.
3,368,453 A * 2/1968 Shaw ..... F41A 21/36 89/14.3
3,385,164 A 5/1968 Walther et al.
3,667,570 A 6/1972 WerBell, III
3,693,750 A 9/1972 Takkunen
3,786,895 A * 1/1974 Perrine ..... F01N 1/086 181/223
4,291,610 A 9/1981 Waiser
4,454,798 A 6/1984 Shea et al.
4,482,027 A 11/1984 Gould
4,501,189 A 2/1985 Brandl et al.
4,510,843 A 4/1985 Rabatin
4,530,417 A 6/1985 Daniel
4,576,083 A * 3/1986 Seberger, Jr. ..... F01N 1/08 181/223
4,583,445 A * 4/1986 Blair ..... F41A 21/36 89/14.2
4,588,043 A 5/1986 Finn
4,907,488 A 3/1990 Seberger
4,930,396 A 6/1990 Johnson
4,946,105 A 8/1990 Pan, Jr. et al.
4,974,489 A 12/1990 Fishbaugh
5,010,676 A 4/1991 Kennedy
5,029,512 A 7/1991 Latka
5,036,747 A 8/1991 McClain, III
5,078,043 A 1/1992 Stephens
5,092,223 A * 3/1992 Hudson ..... F41A 21/38 89/14.2
5,136,924 A 8/1992 Foerster et al.
5,164,535 A 11/1992 Leasure
5,425,299 A 6/1995 Teetzel
5,433,133 A 7/1995 LaFrance
5,486,425 A 1/1996 Seibert
5,590,484 A 1/1997 Mooney et al.
5,656,166 A 8/1997 Linnersten et al.
5,661,255 A 8/1997 Webb, III
5,679,916 A 10/1997 Weichert
5,698,810 A 12/1997 Rose
5,777,258 A 7/1998 Soon
5,952,625 A 9/1999 Huff
6,079,311 A 6/2000 O'Quinn et al.
6,298,764 B1 10/2001 Sherman et al.
6,302,009 B1 10/2001 O'Quinn et al.
6,308,609 B1 10/2001 Davies
6,374,718 B1 4/2002 Rescigno
6,376,565 B1 4/2002 Dyer et al.
6,425,310 B1 7/2002 Champion
6,490,822 B1 12/2002 Swan
6,499,245 B1 12/2002 Swan
6,575,074 B1 6/2003 Gaddini
6,732,628 B1 5/2004 Coburn et al.
6,792,711 B2 9/2004 Battaglia
6,796,214 B2 9/2004 Hausken et al.
6,959,509 B2 11/2005 Vais
7,308,967 B1 12/2007 Hoel
7,587,969 B2 9/2009 Silvers
7,610,710 B2 11/2009 Brittingham
7,661,349 B1 2/2010 Brittingham
7,676,976 B2 3/2010 Dueck et al.
7,707,762 B1 5/2010 Swan
7,789,008 B2 9/2010 Petersen
7,823,314 B1 11/2010 Wheatley
7,832,323 B1 11/2010 Davies
7,836,809 B2 * 11/2010 Noveske ..... F41A 21/34 89/14.4
7,870,815 B2 * 1/2011 Hung ..... F41A 21/34 89/14.2
7,905,319 B2 3/2011 Sullivan
7,987,944 B1 8/2011 Brittingham et al.
8,167,084 B1 5/2012 Moore
8,196,701 B1 6/2012 Oliver
8,286,750 B1 10/2012 Oliver
8,307,946 B1 11/2012 Johnston
8,490,535 B1 7/2013 Moore et al.
8,516,941 B1 8/2013 Oliver
8,522,662 B2 9/2013 Presz, Jr. et al.
8,579,075 B2 11/2013 Brittingham et al.
8,671,818 B1 3/2014 Oliver
8,790,434 B1 7/2014 Oliver
8,826,793 B2 9/2014 Oliver
8,844,422 B1 * 9/2014 Klett ..... F41A 21/30 89/14.2
8,875,612 B1 11/2014 Klett et al.
8,973,481 B2 3/2015 Dueck et al.
9,052,152 B2 6/2015 Moss et al.
9,163,891 B1 * 10/2015 Dater ..... F41A 21/34
9,175,920 B2 11/2015 Moore
9,194,640 B2 11/2015 Wirth et al.
9,207,033 B2 12/2015 Vais
9,239,201 B1 1/2016 Reis Green
9,316,456 B1 4/2016 Oliver
9,347,727 B1 5/2016 Cler
9,410,761 B2 8/2016 Morris et al.
9,423,198 B1 8/2016 Oliver
9,435,600 B2 9/2016 Oliver
9,482,484 B2 11/2016 Barney
9,500,427 B1 11/2016 Larue
9,709,354 B2 * 7/2017 Larue ..... F41A 21/325
9,835,399 B1 12/2017 Lessaed
10,024,617 B1 * 7/2018 Moore ..... F41A 21/30
10,030,929 B1 7/2018 Lessard
10,126,084 B1 11/2018 Oglesby
10,228,210 B2 3/2019 Parker
10,234,231 B2 3/2019 Gianelloni, III et al.
10,254,068 B2 4/2019 Piemme et al.
10,371,476 B1 8/2019 Oglesby
10,393,463 B1 * 8/2019 Sanders ..... F41A 21/325
10,415,917 B2 9/2019 White
10,458,739 B2 10/2019 Smith
10,480,883 B2 11/2019 Smith
10,480,888 B2 11/2019 Barrett
10,502,513 B2 12/2019 Ellison et al.
10,533,819 B2 1/2020 Thomas
10,634,445 B1 4/2020 Klett
10,648,756 B2 5/2020 Mooty
10,655,926 B2 * 5/2020 Young ..... F41A 21/325
10,690,432 B2 6/2020 Campbell et al.
10,746,491 B2 8/2020 Garst et al.
10,753,699 B2 8/2020 Klett et al.
10,890,403 B2 1/2021 Petersen
10,890,404 B2 1/2021 Petersen
2007/0107590 A1 5/2007 Silvers
2007/0107982 A1 5/2007 Sullivan
2007/0256347 A1 11/2007 Fitzpatrick et al.
2009/0200105 A1 8/2009 Geyer, III
2009/0235568 A1 9/2009 Auvine
2010/0048752 A1 2/2010 Vignola et al.
2010/0163336 A1 7/2010 Presz, Jr. et al.
2010/0199834 A1 8/2010 Dueck et al.
2011/0067950 A1 3/2011 Shults et al.
2012/0272818 A1 11/2012 Dueck et al.
2014/0035076 A1 2/2014 Zhang et al.
2014/0262605 A1 9/2014 Washburn, III et al.
2014/0353076 A1 12/2014 Bethlenfalvy
2014/0360807 A1 12/2014 McKenzie
2015/0136519 A1 5/2015 Moore
2015/0253099 A1 9/2015 Shults
2015/0260472 A1 9/2015 Smith
2016/0084602 A1 3/2016 Smith
2016/0109205 A1 4/2016 Coppinger et al.
2016/0238335 A1 8/2016 Bertschinger et al.
2017/0160034 A1 6/2017 Parker

(56) References Cited

U.S. PATENT DOCUMENTS

| | | | | |
|---|---|---|---|---|
| 2017/0299314 | A1 | 10/2017 | Palu | |
| 2017/0321984 | A1 | 11/2017 | Palu et al. | |
| 2018/0135932 | A1* | 5/2018 | Tomczak | F41A 21/30 |
| 2018/0313626 | A1 | 11/2018 | Tomczak | |
| 2018/0313627 | A1 | 11/2018 | Tomczak | |
| 2018/0340750 | A1 | 11/2018 | Mooty | |
| 2019/0257607 | A1 | 8/2019 | Dobrinescu | |
| 2020/0064099 | A1 | 2/2020 | Young et al. | |
| 2020/0096279 | A1 | 3/2020 | Hibbitts et al. | |
| 2020/0116450 | A1 | 4/2020 | Ellison et al. | |
| 2020/0224989 | A1* | 7/2020 | Bundy | F41A 21/30 |
| 2020/0240737 | A1* | 7/2020 | Wheeler | F41A 21/38 |
| 2020/0263947 | A1* | 8/2020 | Calderwood | F41A 21/36 |
| 2021/0071979 | A1* | 3/2021 | Plunkett, Jr. | F41A 21/30 |

FOREIGN PATENT DOCUMENTS

| | | | |
|---|---|---|---|
| GB | 2287780 | A | 9/1995 |
| GB | 2288007 | A | 10/1995 |
| WO | 9902826 | A1 | 1/1999 |
| WO | 2015016998 | | 2/2015 |
| WO | 2020081268 | A2 | 4/2020 |

OTHER PUBLICATIONS

RAD 22 Suppressor, OSSSuppressors.com, https://osssuppressors.com/suppressors/rimfire/ (last visited Apr. 29, 2019).
RetroRifles.com, M16A1 Birdcage Flash Hider, available at https://retrorifles.com/m16a1-birdcage-flash-hider-4-options/ (last visited Dec. 17, 2019).
Operators Suppressor Systems, Info Sheet (2015).

* cited by examiner

INTEGRATED FLASH HIDER FOR SMALL ARMS SUPPRESSORS

FIELD OF THE DISCLOSURE

This disclosure relates to muzzle accessories for use with small arms, and more particularly to a flash hider and suppressor incorporating a flash hider.

BACKGROUND

Firearm design involves many non-trivial challenges. In particular, firearms such as rifles and machine guns have faced complications with reducing the audible and visible signature produced by firing the weapon, while also maintaining the desired performance. Some accessories are designed to be mounted to the muzzle-end of a firearm barrel in one or more particular rotational orientations to accomplish a desired effect. For example, a muzzle brake is typically mounted to a firearm barrel in a particular rotational orientation in order to direct propellant gases sideways or rearward from the barrel and to prevent gases from being redirected upward into the line of sight of the firearm operator or downward where they may stir up dust. Suppressors are another muzzle accessory intended to reduce the audible report of the firearm. Suppressors are generally configured to slow the expansion and release of pressurized gases from the barrel of the firearm, thereby reducing the audible report when discharging the firearm. A flash hider is yet another muzzle accessory that is designed to reduce the visible signature of the firearm by controlling the expansion of propellant gases exiting the muzzle. The flash hider controls the expansion of propellant gases exiting the barrel to reduce visible flash.

Figure 1A:
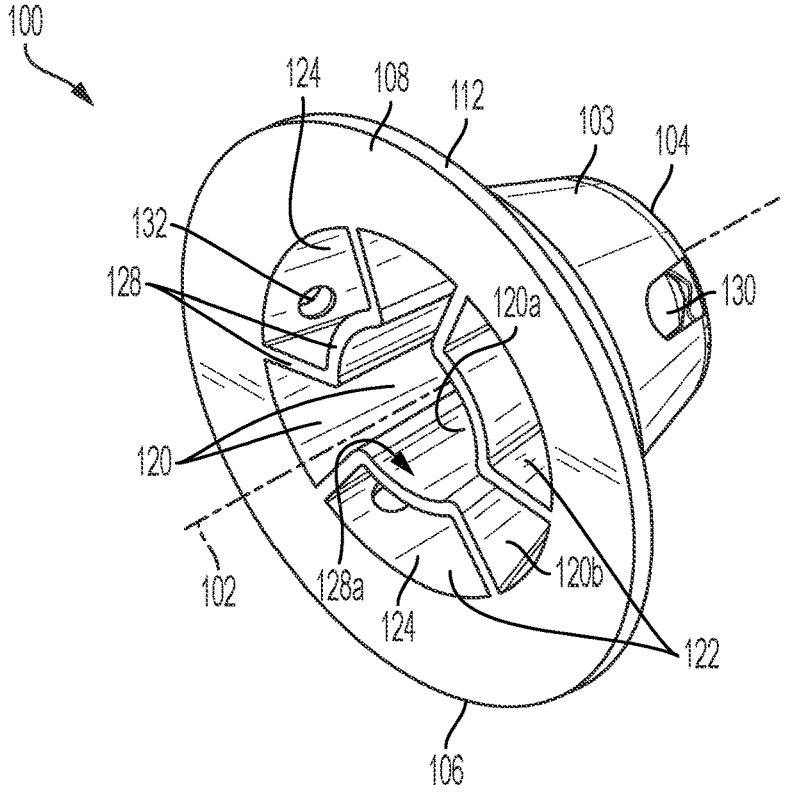
FIGS. 1A and 1B illustrates a front perspective view and a front-end view, respectively, of a flash hider with a first flash hider portion and a second flash hider portion, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a flash hider for a firearm and a suppressor including the flash hider, in accordance with some embodiments of the present disclosure. Depending on the intended application and the performance sought, a suppressor assembly with an integral flash hider can be configured for various levels of audible and/or visual signature reduction. In addition, the suppressor optionally can be configured to reduce the gas backflow into the firearm's receiver, as can occur when a suppressor is used with semi-automatic and automatic rifles.

In accordance with one embodiment of the present disclosure, a flash hider has a body with an outer wall that extends along a central axis from a proximal end to a distal end. For example, the outer wall has a frustoconical shape. The proximal end defines a central opening to an inner or central volume that expands along the central axis to the distal end. One or more outer volumes are located radially outside of the central volume. For example, some or all of the outer volumes can communicate with the central volume. In some such embodiments, the central volume and outer volumes comprise a first flash hider portion. In another example, some or all of the outer volumes are isolated from the central volume along the length of the flash hider, where such outer volumes are part of a second flash hider portion.

In some embodiments, outer volumes are distributed circumferentially about the central volume. In one example, the outer volumes have a circumferentially spaced-apart arrangement, where the outer volumes are defined between flow partitions extending inward from the outer wall of the flash hider body. In one such embodiment, each flow partition generally has a U-shape with sides and an inner surface. For example, the flow partition is a 3-dimensional solid or hollow structure extending inward towards the central axis from the outer wall. The negative space between adjacent flow partitions defines an outer volume or gas expansion region that directs exiting propellant gas away from central axis. In some such embodiments, the outer volumes are continuous with the central volume and function as expansion chambers for propellant gases entering the flash hider through the central opening.

In another embodiment, the flash hider has a first flash hider portion and a second flash hider portion. The first flash hider portion includes an inner volume and a plurality of outer volumes in communication with the inner volume. Some of the outer volumes are isolated from the central volume and receive propellant gasses through vent openings in the outer wall. These outer volumes are part of the second flash hider portion and are interspersed circumferentially with the outer volumes of the first flash hider portion. In one example, the flow partitions are hollow and define gas passageways that are isolated from the first flash hider portion by the walls defining the flow partition.

In some embodiments, the flash hider can include forward venting ports to vent off-axis gas flows and reduce the pressure of flow through the central volume. In one example, a first portion of gases entering the flash hider through the central opening flow through inner and outer volumes of the first flash hider portion. A second portion of gases, such as off-axis gas flows in the suppressor, can enter the passageways of the second flash hider portion via the vent openings, where the second flash hider portion provides an additional flow path for propellant gases to exit the suppressor. In another example, the flash hider defines openings through a flange extending radially outward from the distal end of the suppressor body. The flange openings can be a third flash hider portion that vent gases from an outer chamber in the suppressor, for example.

In accordance with some embodiments, first and second flash hider portions can be configured to provide the desired level of flash suppression. The flash hider can be integral to the distal end of a suppressor assembly and can have flash hider portions corresponding to central and radially outer gas flow paths through the suppressor, such as a first flash hider portion for gases flowing along a central axis of the suppressor and a second flash hider portion for radially outer gas flows through the suppressor. In addition to reducing or controlling flash, some flash hiders of the present disclosure can reduce the build-up of pressure in the suppressor and therefore reduce the amount of propellant gases flowing backward to the receiver of semiautomatic and automatic firearms.

General Overview

As noted above, non-trivial issues may arise that complicate weapons design and performance of firearms. For instance, one non-trivial issue pertains to the fact that the discharge of a firearm normally produces an audible and visible signature that results from rapidly expanding propellant gases and from the projectile leaving the muzzle at a velocity greater than the speed of sound. It is generally understood that attenuating the audible report may be accomplished by slowing the rate of expansion of the propellant gases. Reducing the visible signature or flash can be accomplished by controlling the expansion of gases exiting the muzzle. Muzzle flash may include two main components. A red glow is visible where gas flow transitions from supersonic to subsonic flow, sometimes referred to as a Mach disk or flow diamond. A brighter or white flash is visible when oxygen from the ambient air ignites and burns with the propellant gases.

In general, a flash hider can reduce the visible signature by lowering the temperature and velocity of gases that exit the muzzle and by promoting a controlled, gradual expansion of the gases. More specifically, it has been found that the size of the Mach disk and the position of the Mach disk relative to the muzzle can be controlled with certain features of the flash hider. For example, flash can be reduced by reducing the amount of ambient air that mixes with gases exiting the muzzle (e.g., by reducing turbulence) restricting the gas expansion, or both. Reducing flash is a function of temperature, pressure, barrel length, the type of ammunition being fired, and other factors. Reducing one component of muzzle flash may enhance another component of flash, as will be appreciated. Thus, reducing the visible signature while also reducing the audible signature of a firearm presents non-trivial challenges.

By slowing down the expansion and release of combustion from the muzzle when a shot is fired, some suppressor designs result in a containment, trapping, and delayed release of pressurized gas from the suppressor. A localized volume of high-pressure gas within the suppressor naturally follows the path of least resistance to regions of lower pressure. Such condition is generally not problematic in the case of a bolt-action rifle because the operator opens the bolt to eject the spent casing in a time frame that is much greater than the time required for the gases in the suppressor to disperse through the distal (forward) end of the suppressor. However, in the case of a semi-automatic rifles, automatic rifles, or a machine gun, the bolt opens very quickly after firing (e.g., 1-10 milliseconds) to reload and cock the firearm for the next shot. In this short time, pressurized gases in the suppressor may flow back through the barrel and out through the chamber and ejection port towards the operator's face, rather than following the tortuous path to exit through the distal end of suppressor. To avoid introducing particulates and combustion residue to the chamber, and to avoid combustion gases being directed towards the operator's face, it would be desirable to reduce the pressure build up within the suppressor and in turn reduce or eliminate back flow into the firearm's receiver. Additionally, it would be desirable to reduce back flow of gases into the receiver while at the same time retaining effective sound suppression and effective flash suppression.

To address these needs and others, and in accordance with some embodiments of the present disclosure, a flash hider is configured for use with a suppressor for small arms. In some embodiments, the flash hider is an integral part of the suppressor. For example, the flash hider can be made as a single piece with a suppressor body, or the flash hider can be welded or otherwise permanently fixed to the distal end of a suppressor. In other embodiments, the flash hider can be a removable part of the suppressor assembly, such as having a threaded interface with the suppressor body.

In some embodiments, the suppressor includes a first flash hider portion that controls gas expansion along an inner volume of the flash hider as well as providing outer gas expansion chambers radially outside of the inner volume. The flash hider can also include a second flash hider portion that includes one or more gas pathways located outside of the inner volume of the first flash hider portion. In embodiments having the second flash hider portion, the first flash hider portion may or may not include outer volumes. For example, outer volumes of the first flash hider portion are interspersed circumferentially with volumes of the second flash hider portion. The flash hider can be configured to direct a portion of the combustion gases through the first flash hider portion and, in tandem, direct other portions of the combustion gasses through the second flash hider portion.

In one embodiment, a flash hider has a first flash hider portion with an expanding, inner volume that extends along a central axis of the suppressor. A second flash hider portion includes a plurality of outer gas passageways defined by partitions connected to the inside of the flash hider body and extending inward. The gas passageways of the second flash hider portion can be distributed in a circumferentially spaced arrangement around the outside of the inner volume, where the radially inner walls of the partitions circumscribe at least part of the frustoconical inner volume. The first flash hider portion also includes outer volumes between adjacent partitions such that the outer volumes and the gas passageways of the second flash hider portion are interspersed around the outside of the inner volume. Some such embodiments approximate the combination of a three-prong flash hider within a frustoconical flash hider body.

In one example, the second flash hider portion includes three outer passageways, each within flow partitions of the same size (e.g., spanning ~70-80°) and that are evenly spaced circumferentially. Each outer passageway of the second flash hider portion communicates with the volume of the suppressor via vent openings, such as a single rear vent opening and one or more smaller forward vent openings.

In yet other embodiments, the second flash hider portion includes secondary outer passageways radially outward of each outer volume of the first flash hider portion. For example, circumferential wall segments extend between and connect sides of adjacent partitions so as to divide the negative space between adjacent flow partitions into an outer volume of the first flash hider portion and a secondary radially outer volume of the second flash hider portion. In some such embodiments, each secondary radially outer volume communicates with a vent opening in the outer wall and is isolated from the first flash hider portion along the length of the flash hider. Optionally, the flash hider can have a third flash hider portion with gas pathways isolated from those of the first and second flash hider portions. In one example embodiment, a distal face of the flash hider defines through openings that vent gases traveling along an outside chamber or an off-axis flow path of the suppressor.

A flash hider as variously disclosed herein can be a stand-alone muzzle attachment, a permanent part of a suppressor assembly, or a removable portion of a suppressor assembly for a firearm. In one example, the flash hider is integrally formed as a single piece with or otherwise permanently fixed in the distal end portion of a suppressor or suppressor housing. In one such embodiment, gases flowing along the suppressor central axis enter the proximal end of the flash hider through a central opening and exit through passageways of the first flash hider portion. In some embodiments, off-axis gas flows and/or gases flowing through a radially outer chamber in the suppressor exit the suppressor via the second flash hider portion. For example, a portion of the propellant gases flow through vent openings in an outer wall of the flash hider and on through radially outer volumes of the second flash hider portion. In another embodiment, propellant gases in a radially outer chamber of the suppressor vent forward through openings in a distal face of the flash hider. Such openings can be part of a third flash hider portion having flow paths that are distinct from those of the first and second flash hider portions. Numerous variations and embodiments will be apparent in light of the present disclosure.

A suppressor including a flash hider in accordance with the present disclosure can reduce flash in the visible and infrared wavelengths emitted from the distal end of the suppressor. Also, being integrated into the suppressor, the suppressor housing protects the relatively thin walls of the flash hider from damage and eliminates the open prongs found in other flash hiders that are prone to snag on vegetation or the like. Another advantage is to provide a variety of pathways for propellant gases to exit the distal end of the suppressor, which can reduce both flash and pressure build up, in accordance with some embodiments.

A flash hider or a suppressor including the flash hider can be manufactured by molding, casting, machining, 3-D printing, or other suitable techniques. For example, additive manufacturing—also referred to as 3-D printing—can facilitate manufacture of complex geometries that would be difficult or impossible to make using conventional machining techniques.

Flash hiders of the present disclosure are illustrated as having a frustoconical geometry or other geometry with a circular cross-sectional shape. Other cross-sectional shapes can be used, such as square, rectangular, hexagonal, elliptical, or other closed geometry. Additionally, surfaces are illustrated has having a smooth arcuate shape. The present disclosure is not limited to the geometries illustrated and such surfaces could similarly be faceted, planar, sinuous, zig-zag, or have other profiles. Further, some embodiments including an inner wall and an outer wall are illustrated with these walls both having a frustoconical geometry. It is contemplated that the inner wall and the outer wall need not have the same cross-sectional shape. Thus, the term "annular" encompasses the region between two concentric circles as well as regions between other closed geometries, whether the same or not. For example, the outer wall can have a hexagonal cross-sectional shape while the inner wall has a circular cross-sectional shape. Numerous variations and embodiments will be apparent in light of the present disclosure.

As will be appreciated in light of this disclosure, and in accordance with some embodiments, a suppressor assembly configured as described herein can be utilized with any of a wide range of small arms, including but not limited to, machine guns, semi-automatic rifles, short-barreled rifles, submachine guns, pistol-caliber carbines, pistols, and long-range rifles. In accordance with some example embodiments, a suppressor configured as described herein can be configured for use with a firearm chambered in 5.56×45 mm, 7.62×51 mm, 7.62×39 mm, 6.5 mm Creedmoor, 6.8×51 mm, .300 BLK, or .338 Norma Magnum ammunition, to name a few examples. Examples of some host firearms include the SIG SL MAG, SIG MCX™, SIG516™, SIG556™, SIGM400™, or SIG 716™ rifles produced by Sig Sauer, Inc. Other suitable host firearms and ammunition will be apparent in light of this disclosure.

It should be noted that, while generally referred to herein as a flash hider for consistency and ease of understanding the present disclosure, the disclosed flash hider is not limited to that specific terminology and alternatively can be referred to, for example, as a flash suppressor, a flash guard, a suppressor end cap, or other terms. As will be further appreciated, the particular configuration (e.g., materials, dimensions, etc.) of a flash hider or suppressor configured as described herein may be varied, for example, depending on whether the intended end-use is military, tactical, or civilian in nature. Numerous configurations will be apparent in light of this disclosure.

Example Configurations

Figure 1B:
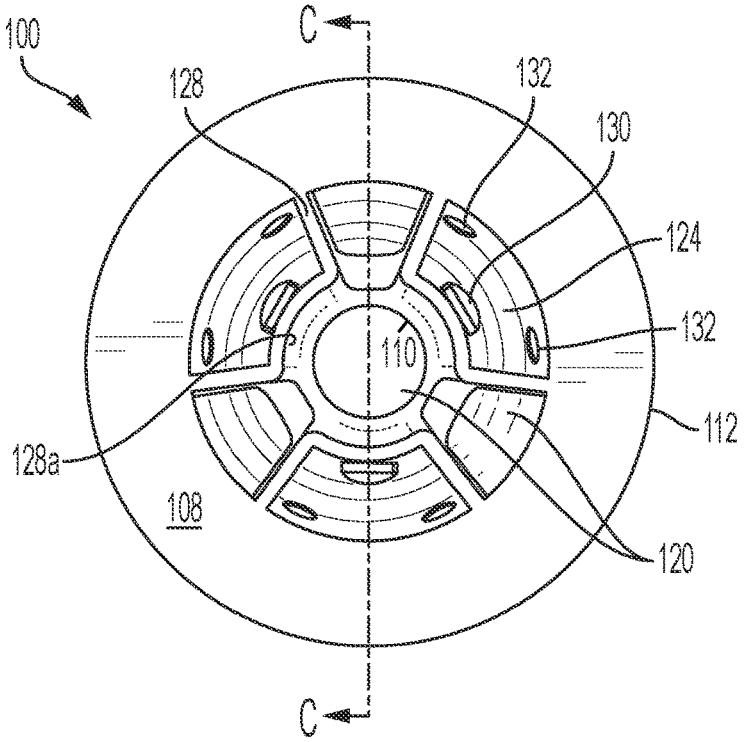
Figure 1C:
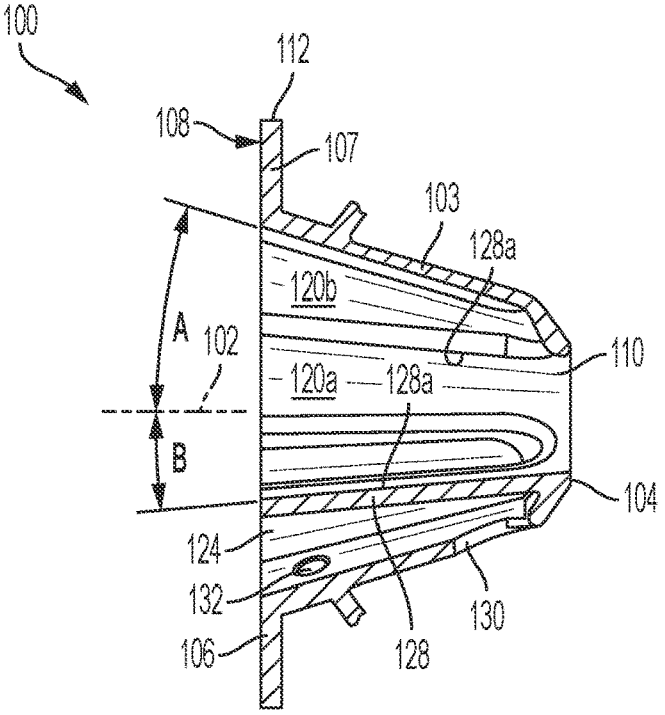
FIG. 1C illustrates a side cross-sectional view of the flash hider as taken along line C-C of FIG. 1B, in accordance with an embodiment of the present disclosure.
Figure 1D:
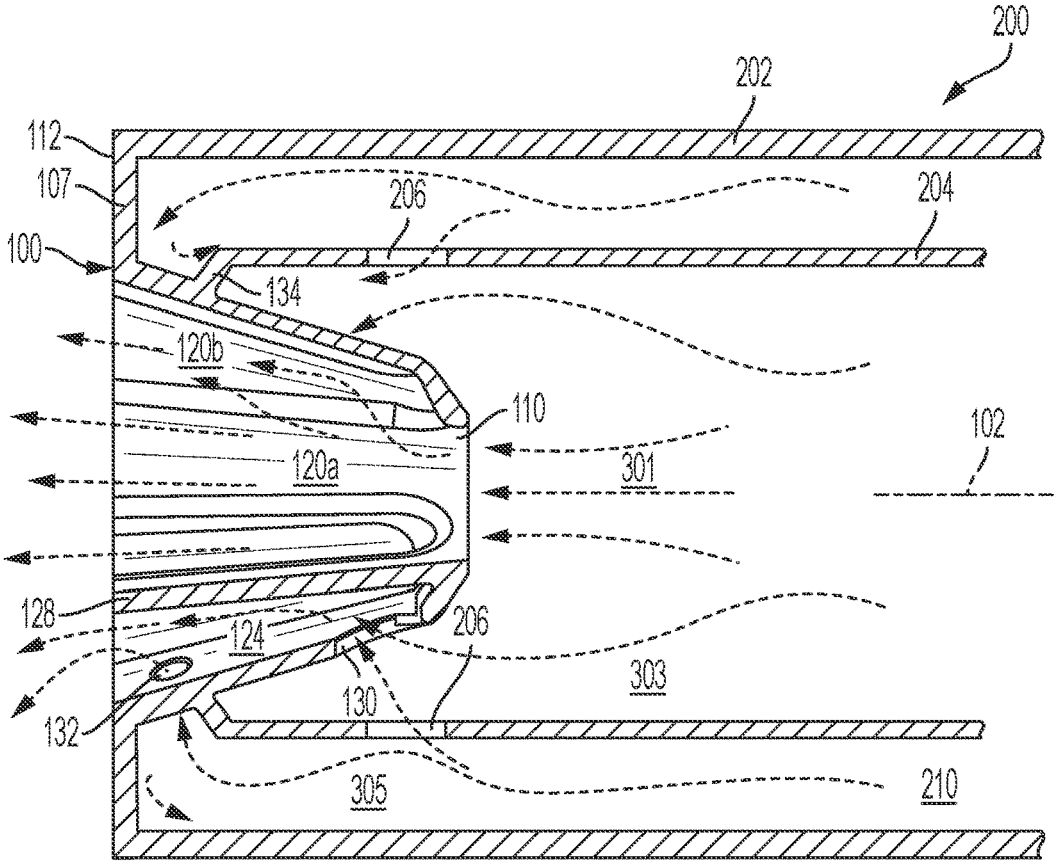
FIG. 1D illustrates a cross-sectional view of the distal end portion of a suppressor that includes the flash hider of FIG. 1C and shows example gas flow paths through the suppressor and flash hider, in accordance with an embodiment of the present disclosure.

FIGS. 1A-1D illustrate a flash hider 100 with a first flash hider portion 120 and a second flash hider portion 122, in accordance with one embodiment of the present disclosure. FIG. 1A is a front perspective view of flash hider 100, FIG. 1B is a front-end view, FIG. 1C is a cross-sectional view taken along line C-C of FIG. 1B, and FIG. 1D is a cross-sectional view showing example gas flow paths through the flash hider when incorporated as part of a suppressor assembly. The flash hider 100 extends along a central axis 102 from a proximal end 104 to a distal end 106. An outer wall 103 extends between and connects the proximal end 104 and distal end 106. The proximal end 104 defines a central opening 110 for passage of a projectile and for gases to enter the first flash hider portion 120. Propellant gases exit through the distal end 106, which, in this embodiment, includes a flange 107 extending radially outward and having a distal face 108 and a rim 112. In some embodiments, the rim 112 can be connected to a suppressor housing 202, such as by welding or a threaded connection.

As can be seen in the side view of FIG. 1C, the outer wall 103 defines an expanding volume as it extends distally. In this example, the outer wall 103 extends from the central opening 110 to the flange 107. The outer wall 103 directs propellant gases away from the central axis 102 and controls the expansion of the propellant gases. In some embodiments, the outer wall 103 has a frustoconical shape that defines an outer wall angle A with respect to the central axis 102. Examples of acceptable values for the outer wall angle A include 10-30°, 15°-20°, and 16-18°. Although illustrated as having a frustoconical geometry, the overall geometry of the flash hider 100 can have other closed cross-sectional shapes, such as a square or rectangle, a hexagon, an octagon, or other polygonal or elliptical shape. Also, although illustrated as having a linear taper, the outer wall 103 (or portions thereof) can have a non-linear shape between the proximal end 104 and the distal end 106, such as curved (e.g., elliptical or parabolic) or a stepped profile.

Gases enter the first flash hider portion 120 through the central opening 110. In this example, the first flash hider portion 120 includes both an inner volume **120*a* and a plurality of outer volumes 120*b*, where the outer volumes 120*b* are continuous with and communicate with the inner volume 120*a*. A first portion of gases enters the first flash hider portion 120 by flowing through the central opening 110 and passing generally along the central axis 102. The first portion of gases can expand into the outer volumes 120*b* between adjacent flow partitions 128 that extend inward towards the central axis 102 from the outer wall 103**.

In this example, each flow partition 128 is a hollow structure defined by a radially inner wall **128*a* and sides connecting the radially inner wall 128*a* to the outer wall 103. As shown in this and other examples, the radially inner wall 128*a* has an arcuate shape; however, each radially inner wall 128*a*** can be planar (flat), faceted, sinuous, or have other geometries. Numerous variations and embodiments will be apparent in light of the present disclosure.

The inner volume **120*a* is circumscribed in part by and defined in part by the radially inner walls 128*a* of the flow partitions 128. Each outer volume 120*b* is positioned radially between the inner volume 120*a* and the outer wall 103. Each outer volume 120*b* is also positioned circumferentially between adjacent flow partitions 128 of the second flash hider portion 122. For example, the inner volume 120*a* has a frustoconical geometry extending along the central axis 102. In some such embodiments, the radially inner walls 128*a* of the flow partitions 128 have an inner wall angle B with the central axis 102** from 4-11°, including 5-8°, or 6-7°, for example. Such a value for the inner wall angle B has been found to slow down propellant gases as they exit to the environment as well as to reduce the amount of hot propellant gases that mix with ambient air/oxygen. Accordingly, and without being constrained to any particular theory, it is believed that such an inner wall angle B permits adequate gas expansion yet also desirably reduces the size of a "Mach disk" or "flow diamond"—appearing as an orange or red flash—as propellant gases transition from supersonic to subsonic flow.

A second portion of gases can enter the second flash hider portion 122 via vent openings 130 and flow through the radially outer volumes 124. In some embodiments, the radially outer volumes 124 of the second flash hider portion 122 are within the flow partitions 128. Accordingly, the radially outer volumes 124 are isolated from the first flash hider portion 120 by flow partitions 128 connected along their lengths to the outer wall 103. In this example, each flow partition 128 connects to the proximal end 104 of the flash hider 100 adjacent the central opening 110 and extends forward to the distal end 106. Accordingly, the flow partition 128 isolates the radially outer volume 124 from the first flash hider portion 120. As viewed from the front, as in FIG. 1B, the radially outer volumes 124 generally resemble sectors of an annulus between the inner volume **120*a* and the outer wall 103**.

Gases can enter the radially outer volumes 124 of the second flash hider portion 122 via vent openings 130 in the outer wall 103, rather than through the central opening 110, in accordance with some embodiments. Optionally, the distal end portion of the outer wall 103 defines one or more distal vent openings 132 in communication with one or more of the radially outer volumes 124 of the second flash hider portion 122. When the flash hider 100 is part of a suppressor assembly, some or all of the gases flowing through the suppressor along a radially outer flow path can enter the second flash hider portion 122 through proximal vent openings 130 and/or through distal vent openings 132 (when present). Absent any openings through the flow partition 128 or gases entering the second flash hider portion 122 from the distal end 106, gases entering the central opening 110 are isolated from and cannot flow through the radially outer volumes 124 of the second flash hider portion 122.

In one example, each flow partition 128 has a shape of a curved rectangle or annular sector as viewed from the distal end 106, where a radially outer volume 124 is defined between the flow partition 128 and the outer wall 103. The radially outer volumes 124 are distributed and spaced circumferentially about the central axis 102. In some embodiments, all flow partitions 128 have the same dimensions and are evenly distributed about the central axis 102, although this is not required.

One advantage of venting radially outer volumes or off-axis flow of the suppressor is to reduce pressure of the gases flowing along the central axis 102. In doing so, flash is also reduced. Venting through the second flash hider portion 122 also can reduce pressure in the suppressor and therefore reduce back flow of gases into the firearm's chamber, such as when used with semi-automatic or automatic rifles. Further, isolating the gas flow through the second flash hider portion 122 from the first flash hider portion 120 inhibits mixing and turbulence, and therefore reduces the visible signature of the firearm, as will be appreciated.

Referring now to FIG. 1D, a cross-sectional view taken along the central axis 102 illustrates example gas flow paths through a suppressor assembly 200 (or simply "suppressor 200") that includes the flash hider 100 of FIGS. 1A-1C. The flash hider 100 is secured in the distal end of the housing 202. For example, the housing connects to the rim 112 of flange 107 by being integrally formed as a single part, or as separate components secured together by welding, a threaded interface, or other suitable attachment method. An inner wall 204 of the suppressor assembly 200 connects to the outer wall 103 of the flash hider 100, such as at flange 134. The suppressor has a radially outer chamber 210 between the inner wall 204 and the housing 202. Note that the flow paths depicted in broken lines are shown for illustration purposes and may not accurately represent the actual flow paths or all flow paths within the suppressor. Also, features on the inside of the suppressor assembly 200 (e.g., baffles, vanes, etc.) are not illustrated.

When a shot is fired, gases 301 flowing along the central axis 102 enter the flash hider 100 through the central opening 110. A first portion of gases 301 expands as it flows along the frustoconical inner volume 120*a*. The first portion of gases 301 further expands into the outer volumes 120*b* of the first flash hider portion 120. Flow partitions 128 extending radially inward from the outer wall 103 function to disperse and cool propellant gases passing through the first flash hider portion 120. The flow partitions 128 can extend linearly or helically along the outer wall 103. In combination, the outer volumes 120*b* of the first flash hider portion 120 provide radial expansion of propellant gases passing through the central opening 110 and direct a portion of the expanding propellant gases away from the central axis 102. At the same time, the inner volume 120*a* directs and controls the expansion of gases traveling along the central axis 102.

A second portion of gases 303 flowing along an off-center flow path radially inside of the inner wall 204 of the suppressor assembly 200 can enter the second flash hider portion 122 through the proximal vent opening 130 and travel through radially outer volumes 124. A third portion of gases 305 in the outer chamber 210 of the suppressor assembly 200 may pass through an opening 206 in the inner wall 204 of the suppressor assembly 200 and mix with the second portion of gases 303, or vice versa. In this example, the third portion of gases 305 flowing through the outer chamber 210 can enter the radially outer volume 124 of the second flash hider portion 122 via distal vent opening 132. In other embodiments, the third portion of gases 305 can vent through openings in the flange 107, as discussed in more detail below.

Note that the radially outer volume 124 of the second flash hider portion 122 is physically separated from the first flash hider portion 120 (including inner volume 120*a* and outer volumes 120*b*) by flow partitions 128 that are attached to the outer wall 103 and define the radially outer volume 124. In some embodiments, the sides of the flow partitions 128 extend substantially radially (e.g., within ±5° of a true radial direction) toward the central axis 102, providing larger radially outer volumes 124 and smaller secondary radially outer volumes 136. Also, as noted above, venting the third portion of gases 305 in the outer chamber 210 and the second portion of gases 303 through the second flash hider portion 122 reduces pressure of the first portion of gases 301 exiting the suppressor through the central opening 110. Venting secondary gas flows through the second flash hider portion 122 can reduce pressure build-up in the suppressor 200, which, especially for semi-automatic and automatic weapons, can reduce gas flow backward into the chamber when the action cycles. Reducing pressure inside the suppressor assembly 200 also reduces velocity and turbulence of the central gas flow, and in turn, the size of the Mach disk is also reduced.

Figure 2A:
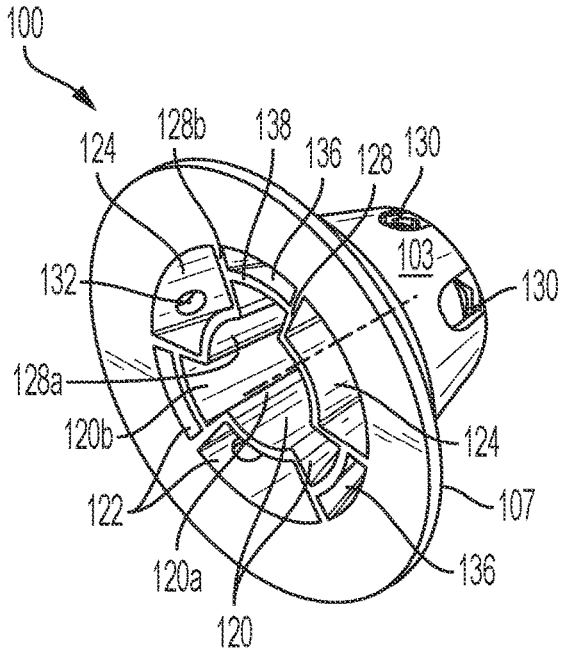
FIGS. 2A, 2B, and 2C illustrate a front perspective view, a front-end view, and a rear perspective view, respectively, of a flash hider having first and second flash hider portions, where the second flash hider portion includes radially outer volumes and secondary radially outer volumes, in accordance with another embodiment of the present disclosure.
Figure 2B:
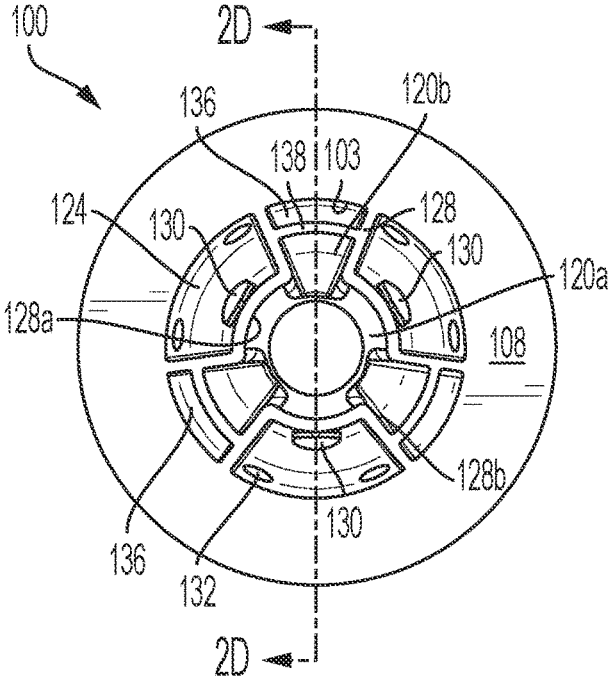
Figure 2C:
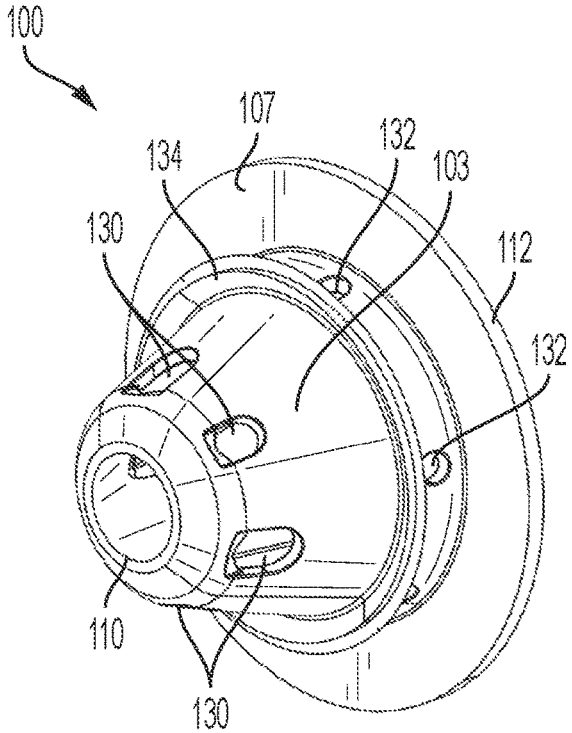
Figure 2D:
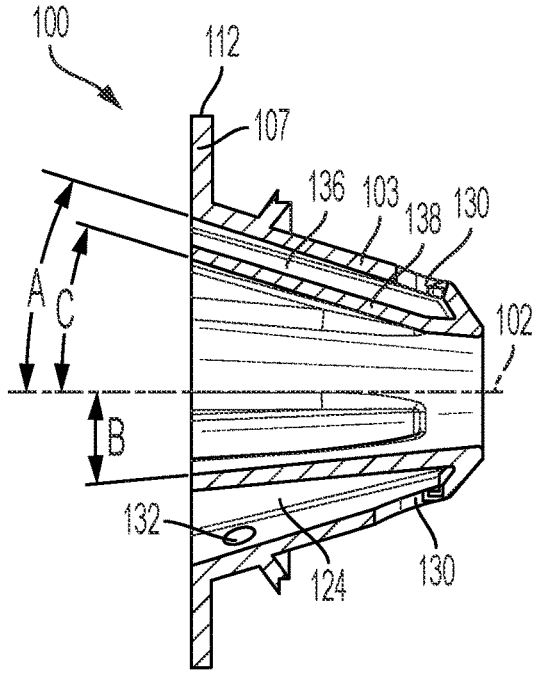
FIG. 2D illustrates a cross-sectional view of the flash hider as taken along line 2D-2D of FIG. 2B, in accordance with an embodiment of the present disclosure.

Referring now to FIGS. 2A-2D, various views illustrate flash hider 100 with a first flash hider portion 120 and a second flash hider portion 122, in accordance with another embodiment of the present disclosure. FIG. 2A shows a front perspective view, FIG. 2B shows a front-end view, and FIG. 2C shows a rear perspective view, and FIG. 2D illustrates a side cross-sectional view as taken along line 2D-2D of FIG. 2B. This example embodiment has some features common to those in the embodiment of FIGS. 1A-1D. One difference, however, is that the second flash hider portion 122 includes secondary radially outer volumes 136 in addition to the (primary) radially outer volumes 124. In general, the secondary radially outer volumes 136 have a reduced volume compared to the radially outer volumes 124, but this is not required. The secondary radially outer volumes 136 are interspersed circumferentially with radially outer volumes 124 along the outer wall 103.

In the example of FIGS. 2A-2D, each of the secondary radially outer volumes 136 is defined in part by a circumferential wall segment 138 extending between and connecting sides of the flow partitions 128 of adjacent radially outer volumes 124. For example, the circumferential wall segment 138 divides the open region between adjacent flow partitions 128 into radially inner and radially outer portions: the radially inner portion between adjacent flow partitions 128 is an outer volume 120*b* of the first flash hider portion 120 and the radially outer portion is a secondary radially outer volume 136 of the second flash hider portion 122. Note that the circumferential wall segments 138 are located radially between the radially inner wall 128*a* of the flow partitions 128 and the outer wall 103, in accordance with some embodiments. Optionally, the outer wall 103 includes a flange 134 or like structure on its outer surface for connecting to an inner wall 204 of a suppressor (e.g., shown in FIG. 1D).

As shown in the side cross-sectional view of FIG. 2D, for example, the secondary radially outer volume 136 is bounded in part by circumferential wall segment 138 that is substantially parallel (e.g., 5°) to the outer wall 103. In some embodiments, the circumferential wall segment 138 defines an angle C with respect to the central axis 102 that has a value from that of inner wall angle B (e.g., 6°) that of outer wall angle A (e.g., 17°). In one example, both angle C and angle A are from 14-20° where angle A is equal to or greater than angle C.

In this example, the flash hider 100 includes three radially outer volumes 124 and three secondary radially outer volumes 136, each of which receives gases through an individual proximal vent opening 130 in the outer wall 103. In other embodiments, the flash hider 100 can include more or fewer radially outer volumes 124 and secondary radially outer volumes 136, such as two, four, five, or other quantity. In yet other embodiments, the number of secondary radially outer volumes 136 need not equal the number of radially outer volumes 124. In one such embodiment, the flash hider 100 has secondary radially outer volumes 136 only between some radially outer volumes 124. For example, the flash hider 100 includes four radially outer volumes 124 rotationally distributed every ninety degrees. Secondary radially outer volumes 136 are arranged 180° from each other between opposite pairs of adjacent radially outer volumes 124. In another embodiment, the secondary radially outer volumes 136 can be concentrated in a certain region, such as along an upper or lower portion of the flash hider 100. Numerous variations and embodiments will be apparent in light of the present disclosure.

In this example, the sides of the flow partitions 128 extend substantially radially (e.g., within ±5° of a true radial direction), providing larger radially outer volumes 124 and smaller secondary radially outer volumes 136. This geometry also increases the ratio of the radially outer volume 124 to secondary radially outer volume 136. Accordingly, to promote greater gas flow through the relatively larger radially outer volumes 124, proximal vent openings 130 can have a relatively larger size for radially outer volumes 124 and a relatively smaller size for secondary radially outer volumes 136, such as shown in FIG. 2C, but this is not required. Optionally, flash hider 100 defines one or more distal vent openings 132 in communication with some or all of the radially outer volumes 124 of the second flash hider portion 122. Distal vent openings 132 can be useful to vent gases from a radially outer chamber 210 of a suppressor (e.g., shown in FIG. 1D) through the second flash hider portion 122. Although not illustrated in FIGS. 2A-2D, distal vent openings 132 can also or alternately be defined in outer wall 103 to communicate with the secondary radially outer volumes 136. Numerous variations and embodiments will be apparent in light of the present disclosure.

In some embodiments, the secondary radially outer volumes 136 can have a reduced radial dimension, a reduced circumferential width, or both, compared to the radially outer volumes 124. The value of angle C contributes to the size of the secondary radially outer volumes 136. The reduced radial size and/or reduced circumferential width may result in a reduced volume compared to that of the radially outer volumes 124, as will be appreciated. In one embodiment, each secondary radially outer volume 136 has a volume that is less than two thirds of one radially outer volume 124, including less than one half, less than one third, less than one quarter, from one quarter to two thirds, one quarter to one half, lone quarter to one third, one third to two thirds of one radially outer volume 124. Numerous variations and embodiments will be apparent in light of the present disclosure.

Figure 3A:
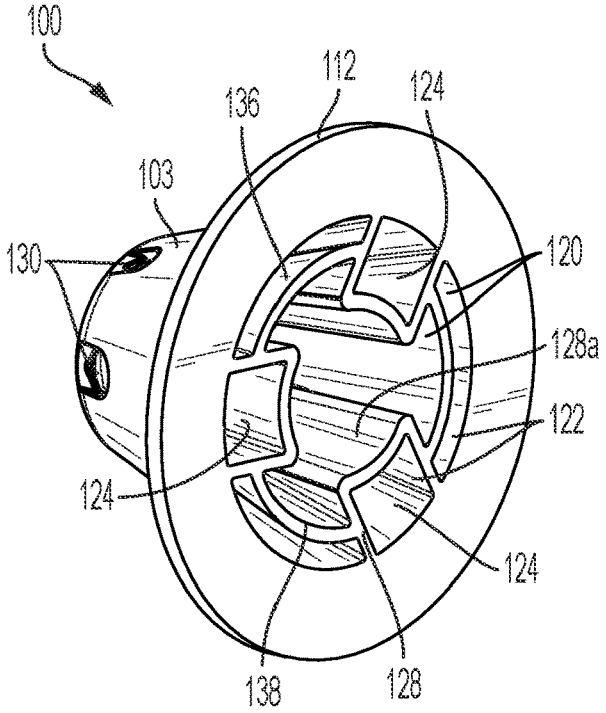
FIGS. 3A-3D illustrate a front perspective view, a front view, a rear perspective view, and a side view, respectively, of a flash hider having first and second flash hider portions, where the first flash hider portion includes an inner volume that is continuous with outer volumes, and where the second flash hider portion includes radially outer volumes and secondary radially outer volumes, in accordance with another embodiment of the present disclosure.
Figure 3B:
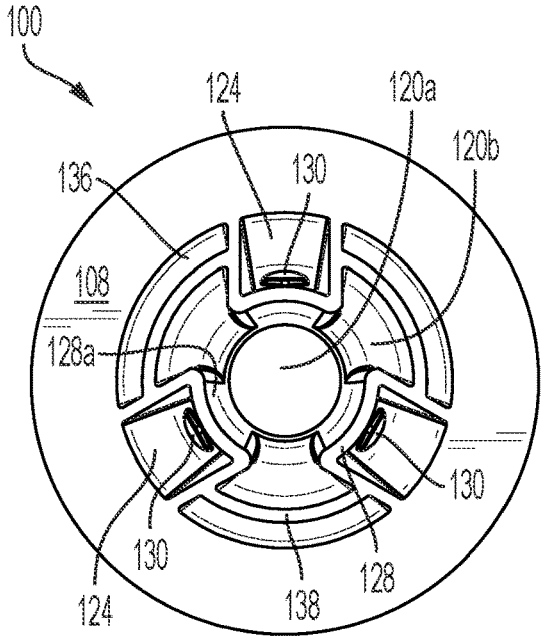
Figure 3C:
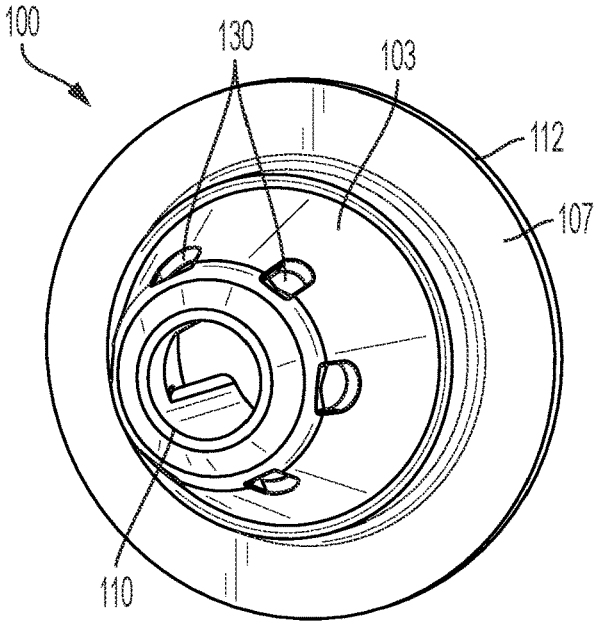
Figure 3D:
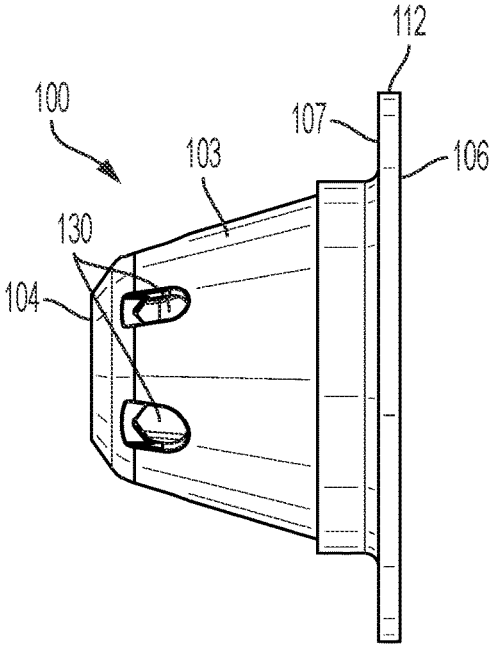

Referring now to FIGS. 3A-3D, various views illustrate a flash hider 100 with first flash hider portion 120 and second flash hider portion 122, in accordance with another embodiment of the present disclosure. FIG. 3A shows a front perspective view, FIG. 3B shows a front-end view, FIG. 3C shows a rear perspective view, and FIG. 3D shows a side view. As with the embodiment of FIGS. 2A-2D, the first flash hider portion 120 includes inner volume 120*a* and outer volumes 120*b*. Inner volume 120*a* is circumscribed by the radially inner walls 128*a* of flow partitions 128. In this example, the inner volume 120*a* has a frustoconical shape circumscribed in part by and defined in part by the radially inner walls 128*a* of the flow partitions 128. The outer volumes 120*b* of the first flash hider portion 120 are continuous with the inner volume 120*a* and are interspersed circumferentially with flow partitions 128 along the inner volume 120*a*.

The second flash hider portion 122 includes radially outer volumes 124 and secondary radially outer volumes 136, which are interspersed along the outer wall 103. Together with a portion of the outer wall 103, each flow partition 128 defines a radially outer volume 124 of the second flash hider portion 122. Each radially outer volume 124 is physically separated from the first flash hider portion 120 by the flow partition 128 and receives gases through a proximal vent opening 130 in the outer wall 103. In this example, each flow partition 128 generally has a square cross-sectional shape. A circumferential wall segment 138 extends between and connects adjacent flow partitions 128. Each secondary radially outer volume 136 is located radially between the circumferential wall segment 138 and the outer wall 103, and circumferentially between adjacent flow partitions 128. In this example, the flash hider 100 has three radially outer volumes 124 interspersed with three secondary radially outer volumes 136. In this embodiment, each radially outer volume 124 has an approximately square cross-sectional shape with substantially parallel sides (e.g., within ±5°) and substantially parallel top and bottom walls (e.g., within ±5°). Each secondary radially outer volume has the shape of an arcuate, elongated rectangle. Other geometries are acceptable.

Figure 4A:
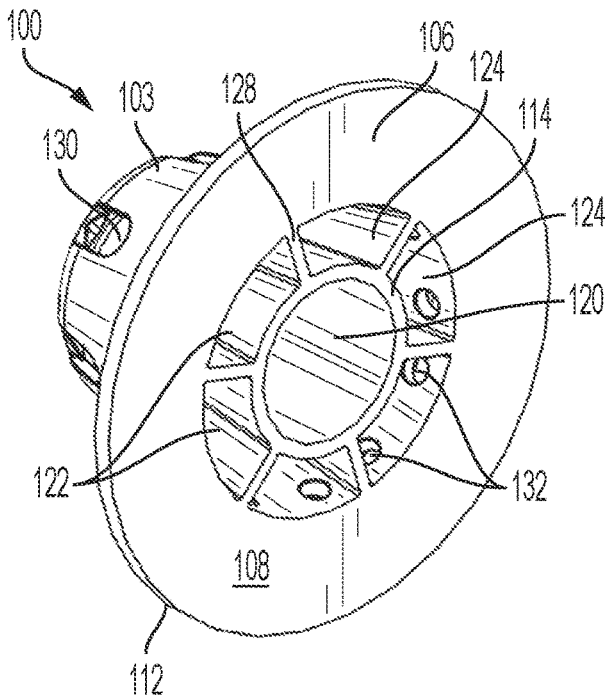
FIGS. 4A-4D illustrate a front perspective view, a rear perspective view, a cross-sectional view, and a side view, respectively, of a flash hider having a first flash hider portion and a second flash hider portion, where the second flash hider portion has a plurality of radially outer volumes positioned radially outside of the inner volume of the first flash hider portion, in accordance with an embodiment of the present disclosure.
Figure 4B:
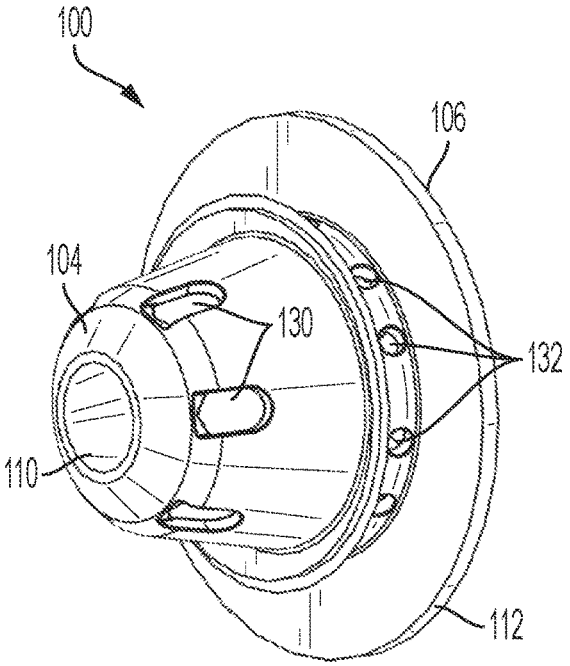
Figure 4C:
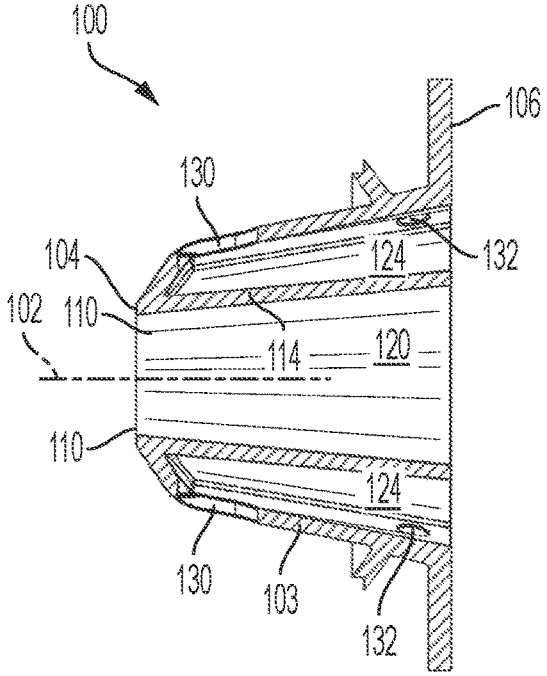
Figure 4D:
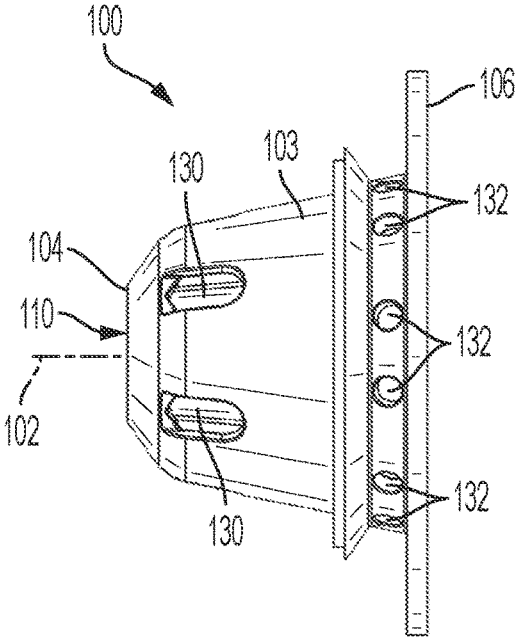

Referring now to FIGS. 4A-4D, various views illustrate flash hider 100 with first flash hider portion 120 and second flash hider portion 122, in accordance with another embodiment of the present disclosure. FIG. 4A shows a front perspective view, FIG. 4B shows a rear perspective view, FIG. 4C shows a cross-sectional view taken along the central axis, and FIG. 4D is a side view.

In this example, the flash hider 100 includes an outer wall 103 and an inner wall 114 coaxially arranged within the outer wall 103. Both the outer wall 103 and the inner wall 114 have a frustoconical shape, but other geometries are acceptable provided that each wall provides an expanding volume for gases flowing through the flash hider 100. The first flash hider portion 120 is defined within the inner wall 114 and extends along the central axis 102. Gases enter the first flash hider portion 120 via the central opening 110 at the proximal end 104 and can expand as permitted and controlled by the inner wall 114.

The second flash hider portion 122 has an annular shape located radially between the inner wall 114 and the outer wall 103. Gases enter the second flash hider portion 122 via proximal vent openings 130. As shown in FIG. 4C, the second flash hider portion 122 is physically separated from the first flash hider portion 120 by inner wall 114. The second flash hider portion 122 can be divided into a plurality of radially outer volumes 124 by flow partitions 128 extending radially between and connecting inner wall 114 and outer wall 103. In this example, each flow partition 128 is can be a wall or fin that extends in a radial direction between the outer wall 103 and the inner wall 114. Flow partitions 128 provide structural stability between inner wall 114 and outer wall 103 and may also reduce turbulence of gas flowing through the second flash hider portion 122, in accordance with some embodiments.

In the example shown, flow partitions 128 divide the annular volume between the inner wall 114 and the outer wall 103 into separate radially outer volumes 124, where adjacent radially outer volumes 124 are separated along their entire axial lengths. In other embodiments, some or all of the flow partitions 128 can be configured to permit some amount of communication between adjacent radially outer volumes 124, such as defining an opening. In one such embodiment, flow partitions 128 extend radially between the inner wall 114 and the outer wall 103 adjacent the front or distal end 106 and extend rearward towards the rear or proximal end 104 along only a portion of the axial distance. In another embodiment, one or more flow partitions 128 define openings that allow communication between adjacent radially outer volumes 124.

In the example of FIGS. 4A-4D, flash hider 100 has six radially outer volumes 124 of equal size that are distributed around the outside of the first flash hider portion 120. More or fewer radially outer volumes 124 can be used, and such volumes need not be of identical size. For example, second flash hider portion 122 can be divided into two, three, four, five, six, seven, eight, or any other number of radially outer volumes 124. In some embodiments, flow partitions 128 may be omitted such that second flash hider portion 122 has a single volume located radially between inner wall 114 and outer wall 113. Although not required, each proximal vent opening 130 communicates with a single radially outer volume 124. In other embodiments, proximal vent openings 130 may deliver gases to two or more radially outer volumes 124. Numerous variations and flow paths can be used, as will be appreciated.

Figure 5A:
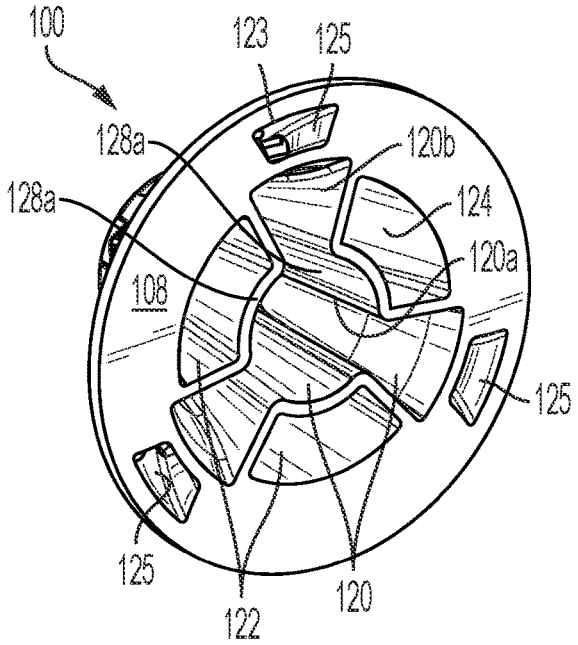
FIGS. 5A-5D illustrate a front perspective view, a rear perspective view, a front view, and a side view, respectively, of a flash hider having first, second, and third flash hider portions, where the first flash hider portion includes an inner volume and outer volumes, the second flash hider portion includes radially outer volumes interspersed with the outer volumes of the first flash hider portion, and the third flash hider portion includes passageways through the flange at the distal end of the flash hider, in accordance with another embodiment of the present disclosure.
Figure 5B:
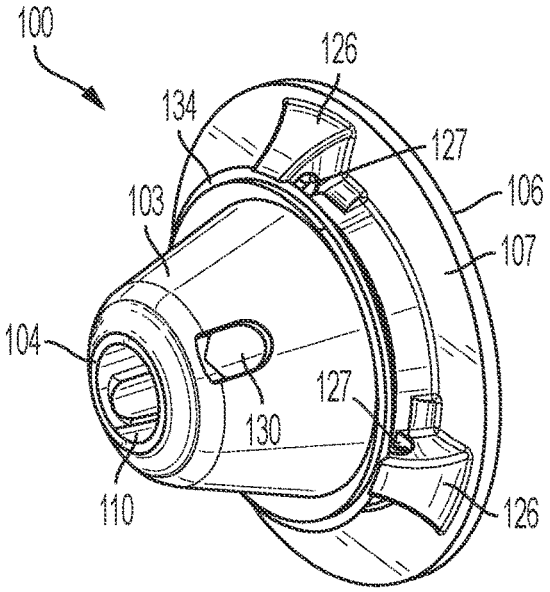
Figure 5C:
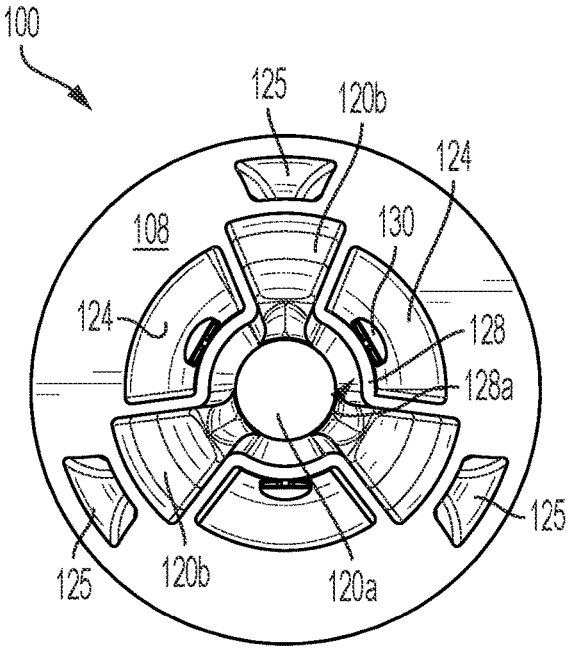
Figure 5D:
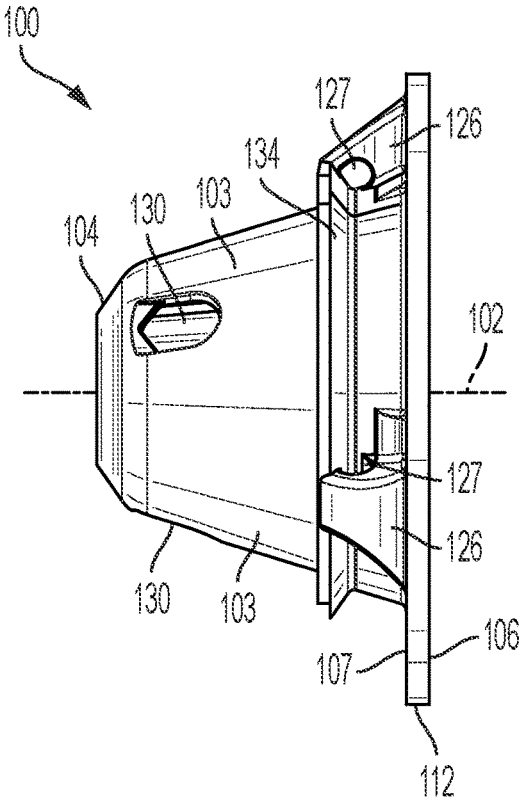

Referring now to FIGS. 5A-5D, various views illustrate a flash hider 100 having first, second, and third flash hider portions, in accordance with another embodiment of the present disclosure. FIG. 5A shows a front perspective view, FIG. 5B shows a rear perspective view, FIG. 5C shows a front-end view, and FIG. 5D shows a side view. Similar to some embodiments discussed above, flash hider 100 includes a first flash hider portion 120 that includes an inner volume 120*a* circumscribed by and defined in part by radially inner walls 128*a* of flow partitions 128 connected to the outer wall 103. In this example, the inner volume 120 has a frustoconical volume that expands moving towards the distal end 106. The first flash hider portion 120 also includes outer volumes 120*b* positioned circumferentially between adjacent flow partitions 128, where the outer volumes 120*b* are continuous with the inner volume 120*a*. Similar to embodiments discussed above, the outer volumes 120*b* allow propellant gases to expand toward the outer wall 103 and direct propellant gases away from the central axis 102. The outer volumes 120*b* provide a greater amount of radial expansion than permitted by the radially inner walls 128*a* of the inner volume 120*a*.

The second flash hider portion 122 includes a plurality of radially outer volumes 124 arranged in a circumferentially spaced-apart relationship along the outer wall 103. The radially outer volumes 124 are circumferentially interspersed with outer volumes 120*b* of the first flash hider portion 120. For example, each flow partition 128 is a hollow structure that is connected to the outer wall 103 and defines a passageway that is isolated from the first flash hider portion 120. In this example, gases enter each radially outer volume 124 through one or more proximal vent openings 130.

Flash hider 100 also includes a third flash hider portion 123 configured to vent gases through openings 125 in distal face 108. When included as part of a suppressor assembly, for example, gases 305 flowing through a radially outer chamber 210 (e.g., shown in FIG. 1D) can vent forward through openings 125 in the distal face 108. In some such embodiments, the suppressor's outer chamber 210 may be largely separated from an inner chamber by an inner wall. For example, the inner wall of the suppressor connects to the flange 134 on the outside of the outer wall 103 of the flash hider 100. In one embodiment, passageways of the third flash hider portion 123 are isolated from the first and second flash hider portions 120, 122.

In one example embodiment, a wall 126 extends rearwardly from a flange 107 at the distal end 106 to the flange 134 along the outer wall 103. The wall 126 defines a passageway for gases to vent through openings 125 in the flange 107. Gases can enter the passageways of the third flash hider portion 123 via ports 127. In one embodiment, the ports 127 are openings in the sides of wall 126 that define the third flash hider portion 123 such that the ports 127 face in a circumferential direction. Such orientation of the ports 127 requires a tortuous path that reduces velocity and energy of gases prior to exiting through the distal face 108. In other embodiments, ports 127 can be axially aligned, can define a serpentine flow path to openings 125, or have some other suitable orientation. In yet other embodiments, wall 126 is omitted and gases can exit directly through openings 125 in flange 107/distal face 108. In such an embodiment, the distal face 108 can define openings 125 in number, size, and orientation as suitable to reduce pressure in a suppressor and/or to reduce the firearm's visible signature. Numerous variations and embodiments will be apparent in light of the present disclosure.

In the example shown in FIGS. 5A-5D, openings 125 of the third flash hider portion 123 are in the flange 107 and therefore are positioned radially outside of outer volumes 120*b* of the first flash hider portion 120. In this example, openings 125 are rotationally aligned with outer volumes 120*b*. In other embodiments, the openings 125 can be radially aligned with the radially outer volumes 124 of the second flash hider portion 122, or they can have some other rotational arrangement that is related or unrelated to other features of the flash hider 100.

Figure 6A:
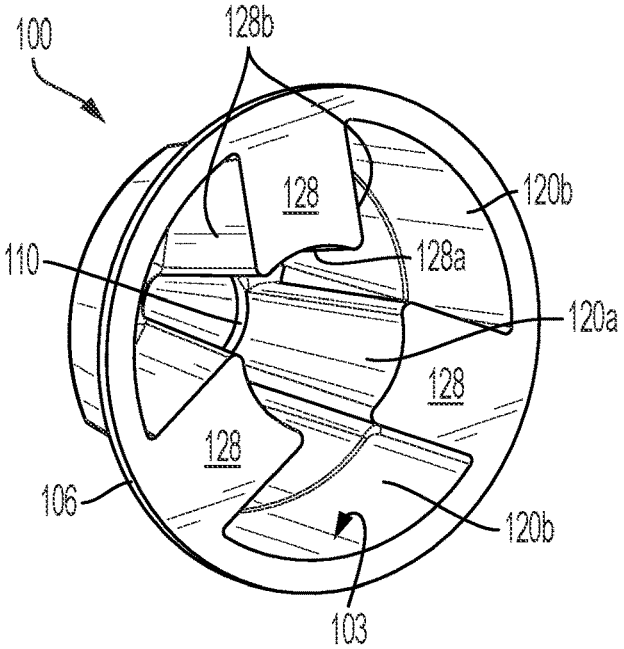
FIGS. 6A-6D illustrate a front perspective view, a rear perspective view, a front view, and a side view, respectively, of a flash hider having a first flash hider portion that includes an inner volume and outer volumes, where sidewalls of each flow partition extend substantially in parallel from the outer wall, in accordance with another embodiment of the present disclosure.
Figure 6B:
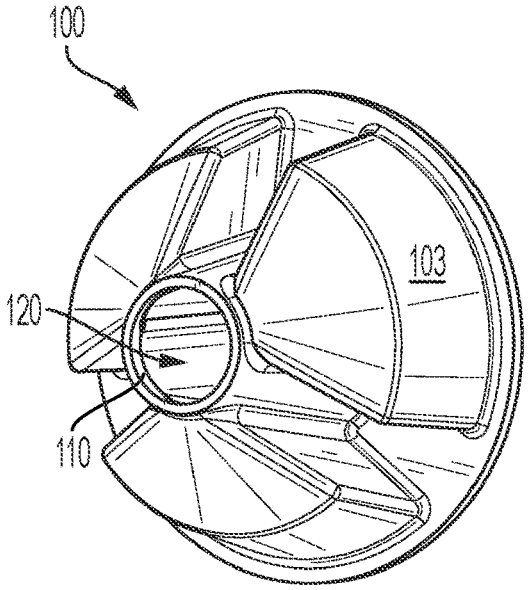
Figure 6C:
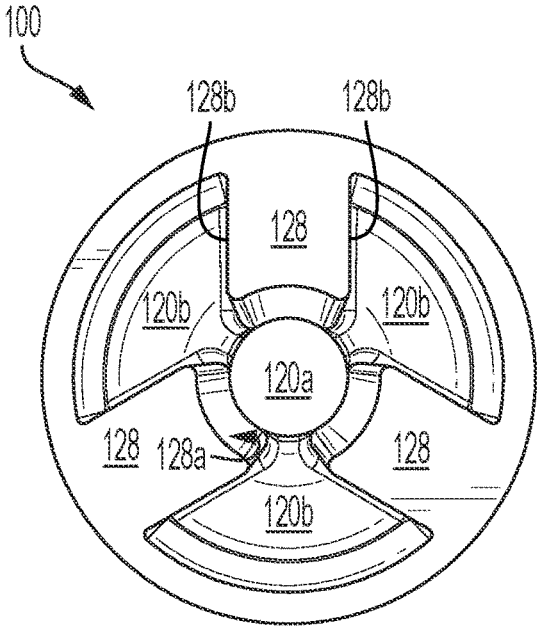
Figure 6D:
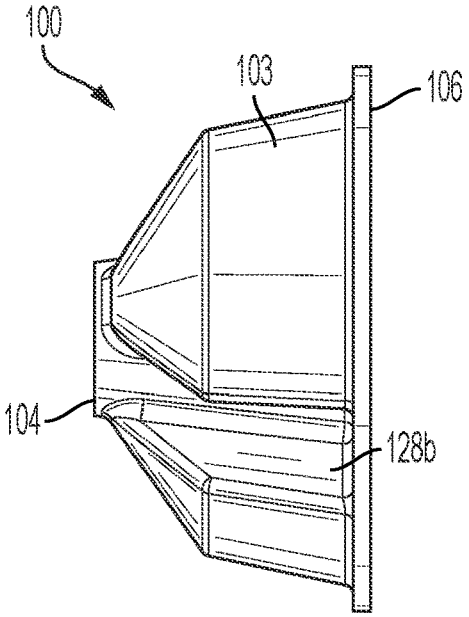

Referring now to FIGS. 6A-6D, various views illustrate a flash hider 100 having a first flash hider portion 120 that includes an inner volume 120*a* and a plurality of outer volumes 120*b*, in accordance with an embodiment of the present disclosure. FIG. 6A shows a front perspective view, FIG. 6B shows a rear perspective view, FIG. 6C shows a front-end view, and FIG. 6D shows a side view. Similar to some embodiments discussed above, the inner volume 120*a* has an expanding volume defined in part by radially inner walls 128*a* of flow partitions 128 extending radially inward from an outer wall 103. Here, the inner volume 120*a* has a frustoconical geometry. The outer wall 103 has a frustoconical shape that is radially outside of and concentric with the inner volume 120*a*. Flow partitions 128 extend into and interrupt the frustoconical volume defined by the outer wall 103 to define outer volumes 120*b* that are positioned circumferentially between adjacent flow partitions 128. Each outer volume 120*b* is continuous with the inner volume 120*a* and provides an expansion chamber for gases flowing through the central opening 110. In this embodiment, sides 128*b* of each flow partition 128 extend substantially in parallel (e.g., within ±5° or ±3°), rather than radially, from the outer wall 103. This geometry provides an increased size of the outer volumes 120*b*. In this example, the flash hider 100 lacks a second flash hider portion 122. Thus, gases can enter the flash hider 100 only through the central opening 110 on the proximal end 104 and then exit from the first flash hider portion 120 at the distal end 106. In accordance with some such embodiments, the flash hider 100 may be suited for applications that demand reduced visible flash but where reduced back flow of gases is not required, such as for use with bolt-action rifles.

Figure 7A:
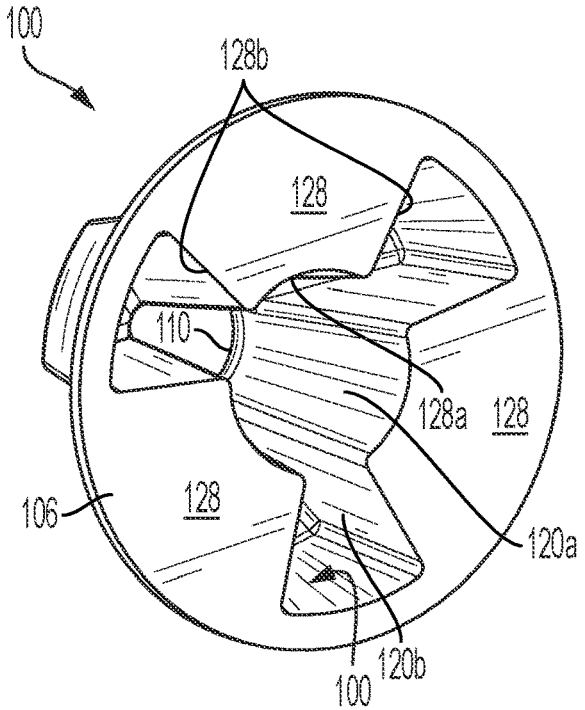
FIGS. 7A-7D illustrate a front perspective view, a rear perspective view, a front view, and a side view, respectively, of a flash hider having a first flash hider portion with an inner volume and outer volumes, where sidewalls of each flow partition extend substantially radially from the outer wall, in accordance with another embodiment of the present disclosure.
Figure 7B:
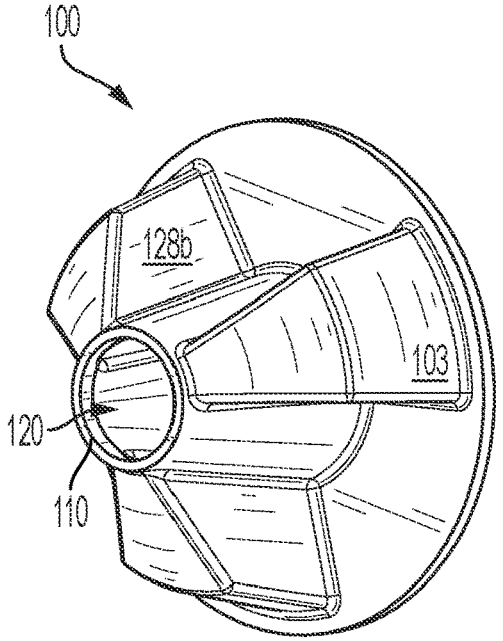
Figure 7C:
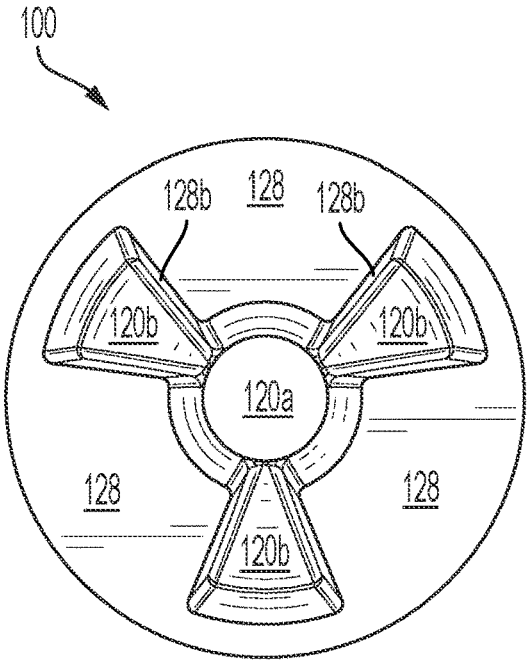
Figure 7D:
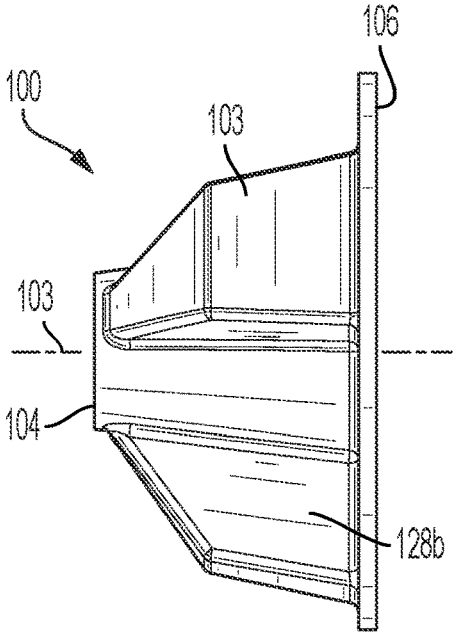

Referring now to FIGS. 7A-7D, various views illustrate a flash hider 100 having a first flash hider portion 120 that includes an inner volume 120*a* and a plurality of outer volumes 120*b*, in accordance with an embodiment of the present disclosure. FIG. 7A shows a front perspective view, FIG. 7B shows a rear perspective view, FIG. 7C shows a front-end view, and FIG. 7D shows a side view. The embodiment of FIGS. 7A-7D is similar to the embodiment of FIGS. 6A-6D. One difference here is that the sides 128*b* of each flow partition 128 extend substantially radially (e.g., ±5°) towards the central axis 102 from the outer wall 103, rather than in parallel. The result of the radially oriented sides 128*b* is that the outer volumes 120*b* have a reduced size and the effect of the inner volume 120*a* is therefore augmented. In this example, the outer wall 103 along each outer volume 120*b* spans approximately 30-50 degrees, whereas the outer wall 103 along the outer volume 120*b* of the embodiment of FIGS. 6A-6D spans approximately 100-110 degrees. As can be seen in the figures, the flash hider 100 of FIGS. 7A-7D also lacks a second flash hider portion and forward vent openings. Accordingly, such an embodiment may be more suited for flash suppression and less suited for reducing back flow of gases into the receiver, as will be appreciated.

Figure 8A:
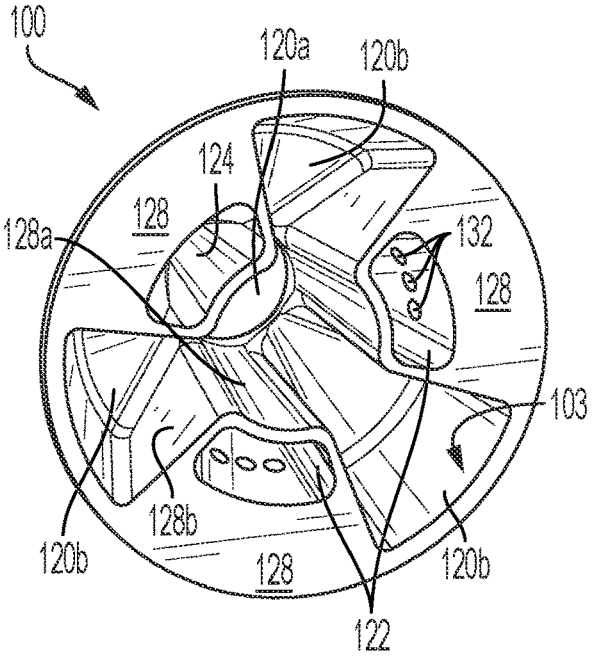
FIGS. 8A-8D illustrate a front perspective view, a rear perspective view, a front view, and a side view, respectively, of a flash hider having a first flash hider portion and a second flash hider portion, where the first flash hider portion includes an inner volume and outer volumes, and where the second flash hider portion includes gas passageways through flow partitions, in accordance with another embodiment of the present disclosure.
Figure 8B:
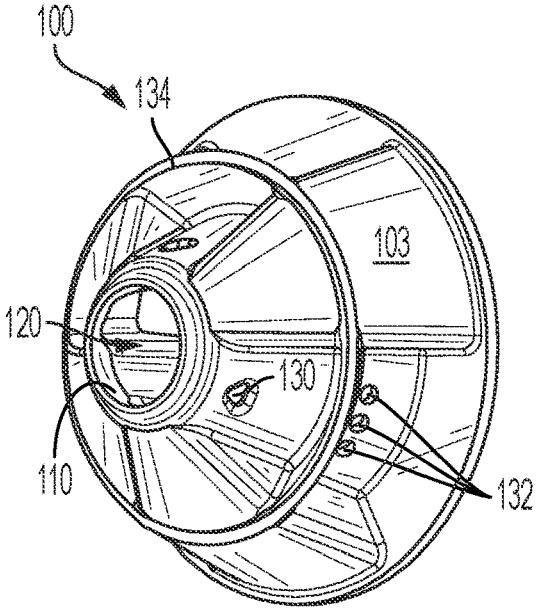
Figure 8C:
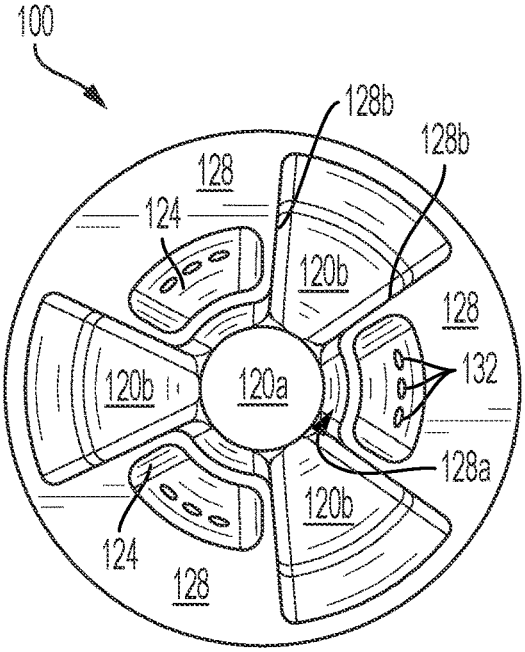
Figure 8D:
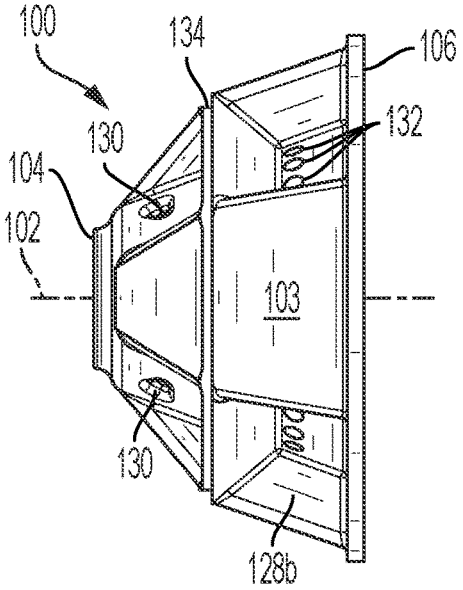

Referring now to FIGS. 8A-8D, various views illustrate a flash hider 100 having a first flash hider portion 120 and a second flash hider portion 122, in accordance with another embodiment of the present disclosure. FIG. 8A shows a front perspective view, FIG. 8B shows a rear perspective view, FIG. 8C shows a front-end view, and FIG. 8D shows a side view. The first flash hider portion 120 includes an inner volume 120*a* and a plurality of outer volumes 120*b* located circumferentially between flow partitions 128, similar to the embodiment shown in FIGS. 7A-7D. Each flow partition 128 has sidewalls that extend substantially radially, therefore providing a relatively reduced gas expansion volume in the outer volumes 120*b*. Note that in various embodiments of the flash hider 100, the sidewalls of the flow partition 128 can extend in parallel, radially, or somewhere between. In contrast to the embodiment of FIGS. 7A-7D, each flow partition 128 defines a radially outer volume 124 that is part of the second flash hider portion 122.

In this example, each radially outer volume 124 is positioned adjacent the radially inner wall 128*a* of each flow partition 128 and is radially outside of the inner volume 120*a* of the first flash hider portion 120. Each radially outer volume 124 radially overlaps part of each outer volume 120*b* of the first flash hider portion 120. The radially outer volumes 124 receive gases via proximal vent openings 130 as well as through one or more distal vent openings 132. In this example, each radially outer volume 124 has one proximal vent opening 130 and three distal vent openings 132. A flange 134 on the outside of the flash hider 100 can be connected to an inner wall of a suppressor, for example. In one such embodiment, a radially outer volume of the suppressor can vent primarily through distal vent openings 132 and off-axis gases inside of the inner wall can vent primarily through the proximal vent openings 130. Gases flowing along the central axis 102 can vent through the central opening 110 and first flash hider portion 120.

Figure 9A:
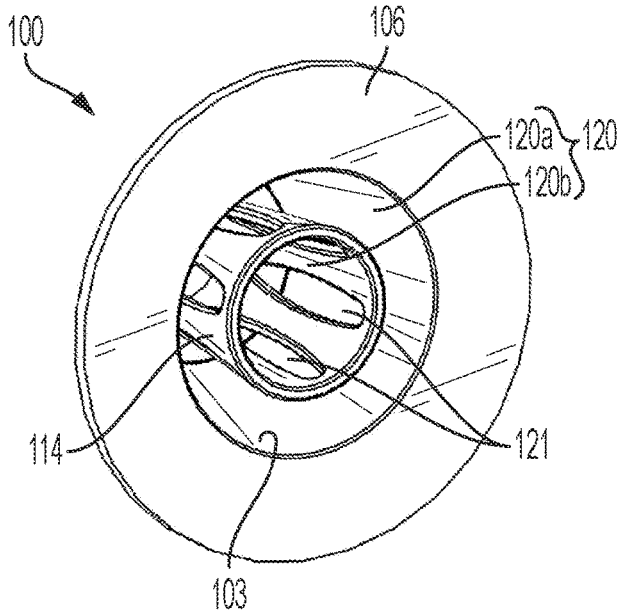
FIGS. 9A-9D illustrate a front perspective view, a rear perspective view, a front view, and a side view, respectively, of a flash hider having a first flash hider portion with inner and outer volumes that are concentrically arranged, in accordance with an embodiment of the present disclosure.
Figure 9B:
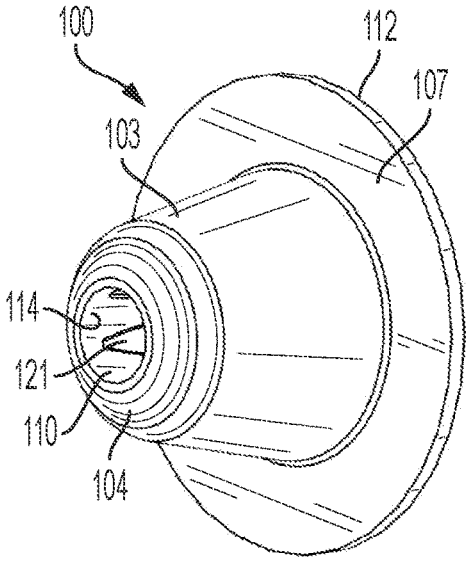
Figure 9C:
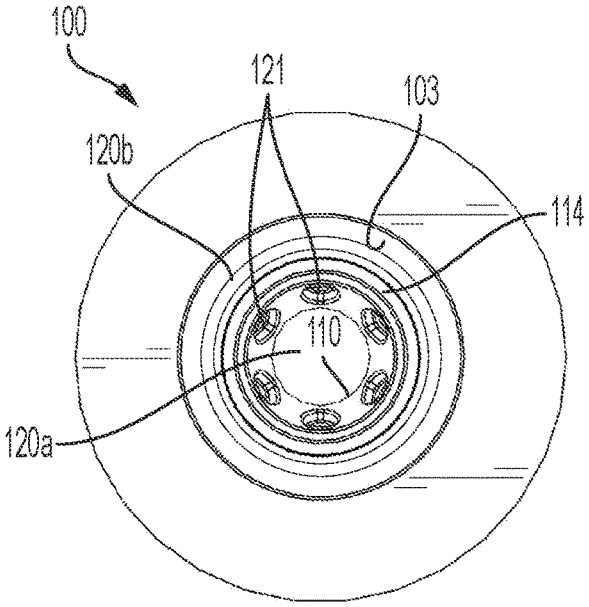
Figure 9D:
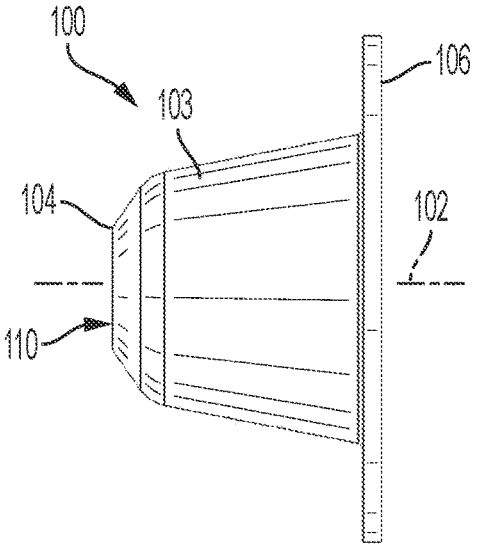

Referring now to FIGS. 9A-9D, various views illustrate a flash hider 100 having a first flash hider portion 120 that includes an inner volume 120*a* and an outer volume 120*b* positioned radially outside the inner volume 120*a*, where the inner volume 120*a* communicates with the outer volume 120*b*, in accordance with an embodiment of the present disclosure. FIG. 9A shows a front perspective view, FIG. 9B shows a rear perspective view, FIG. 9C shows a front-end view, and FIG. 9D shows a side view.

In this example, the flash hider 100 includes an inner wall 114 and an outer wall 103, both having an annular shape extending along a central axis 102 that expands in size moving distally. The inner wall 114 is arranged coaxially within the outer wall 103 and the inner wall 114 is connected to the outer wall 103 at the proximal end 104 of the flash hider 100. As shown in this example, the outer wall 103 and the inner wall 114 both have a frustoconical shape, but other geometries are also acceptable provided that each wall provides an expanding volume for gases flowing through the flash hider 100.

The inner volume 120*a* is defined inside of the inner wall 114 and extends along the central axis 102. The outer volume 120*b* is between the inner wall 114 and the outer wall. As shown here, the outer volume 120*b* can be a single outer volume 120*b* with an annular cross-sectional shape. In other embodiments, the region between the inner wall 114 and the outer wall 103 can be divided into two or more outer volumes 120*b* by flow partitions 128 (shown, e.g., in FIG. 10A) that extend between and connect the inner wall 114 to the outer wall 103. In one such embodiment, the flow partitions 128 extend radially outward from the inner wall 114 to the outer wall 103.

The inner volume 120*a* communicates with the outer volume 120*b* via openings 121 in the inner wall 114. Gases enter the flash hider 100 via the central opening 110 at the proximal end 104 and can expand into the inner volume 120*a*, guided in part by the inner wall 114. These gases can further expand into the outer volume 120*b* through openings 121. In one embodiment, each opening 121 has an elongated shape that extends a majority of the distance from the proximal end 104 to the distal end 106. The openings 121 can have a shape of an oval, diamond, paddle, teardrop, wedge, slit, or some other geometry. Here, each opening 121 has a narrow proximal end and expands in width to a wider middle and distal portion, where the middle portion has the greatest width. The inner wall 114 can define two, three, four, five, six, seven, eight, or any other number of openings 121.

In one embodiment, the inner wall 114 and openings 121 are similar in appearance to the M16A1 "birdcage" flash hider developed for the M16 rifle. Here, however, the inner wall 114 is connected to the proximal end of and positioned within the larger volume of the outer wall 103. Accordingly, gases enter the outer volume 120*b* via openings 121, rather than directly through the central opening 110. That is, gases flowing through the outer volume 120*b* must first enter the inner volume 120*a* and then enter the outer volume 120*b* via the openings 121 in the inner wall 114. Gases expanding through the openings 121 in the inner wall 114 are constrained by the outer wall along the length of the flash hider 100.

Figure 10A:
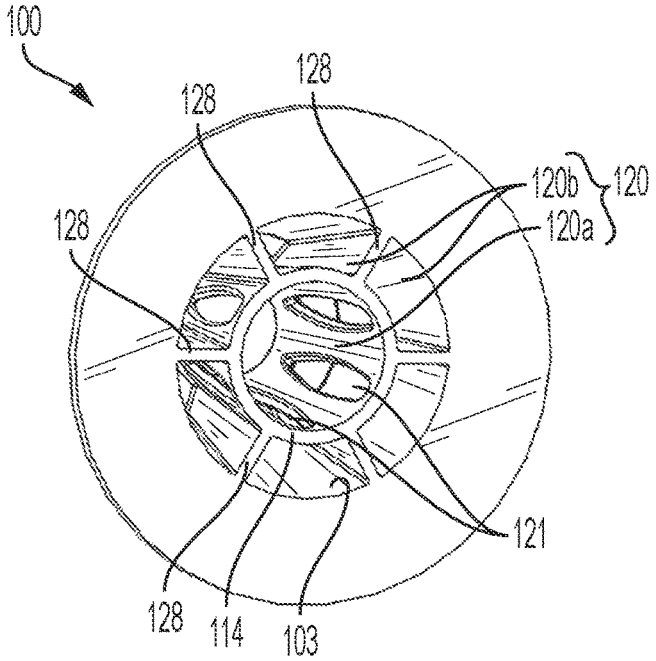
FIGS. 10A-10D illustrate a front perspective view, a rear perspective view, a front view, and a side view, respectively, of a flash hider having a first flash hider portion with an inner volume and a plurality of outer volumes positioned radially outside of the inner volume and communicating with the inner volume via openings in an inner wall, in accordance with an embodiment of the present disclosure.
Figure 10B:
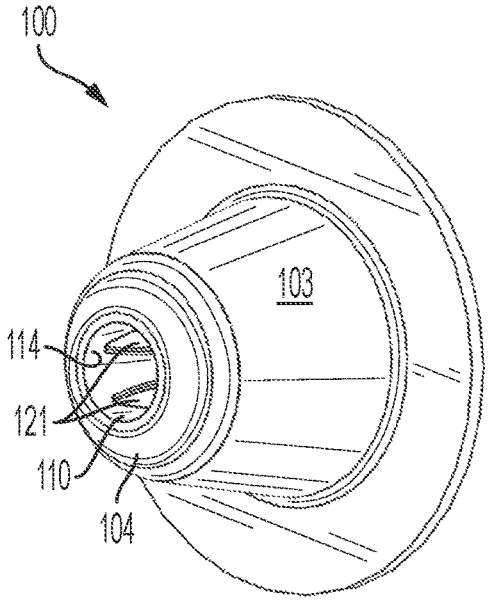
Figure 10C:
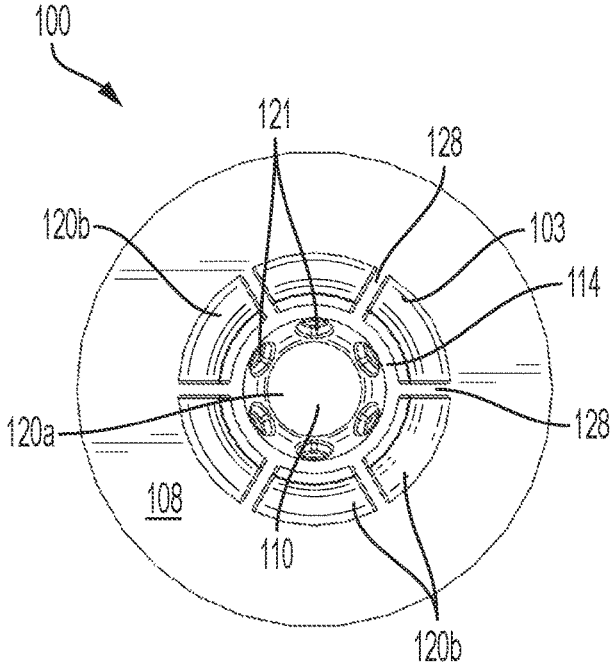
Figure 10D:
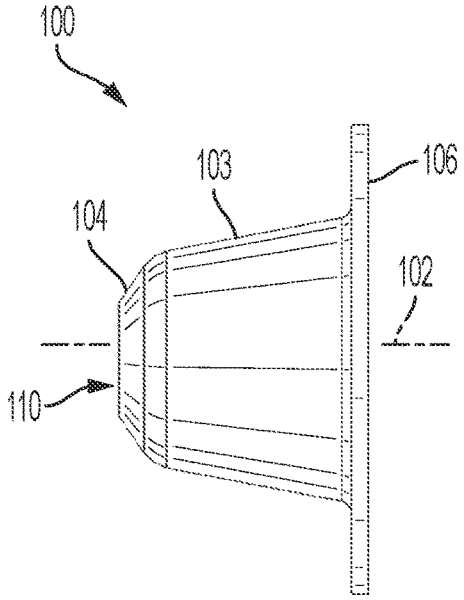

Referring now to FIGS. 10A-10D, various views illustrate a flash hider 100 having a first flash hider portion 120 that includes an inner volume 120*a* and a plurality of outer volumes 120*b* positioned radially outside of the inner volume 120*a*, in accordance with an embodiment of the present disclosure. FIG. 10A shows a front perspective view, FIG. 10B shows a rear perspective view, FIG. 10C shows a front-end view, and FIG. 10D shows a side view. In addition to other similarities, this embodiment is similar to that of FIGS. 9A-9D in that it includes an inner wall 114 arranged coaxially within an outer wall 103, where the inner volume 120*a* communicates with the outer volume 120*b* via openings 121 in the inner wall 114. This embodiment differs, however, in that the annular volume between the inner wall 114 and outer wall 103 is divided into distinct outer volumes 120*b* by flow partitions 128 that extend radially between the inner wall 114 and the outer wall 103. In this example, each flow partition 128 is located between adjacent openings 121 to define six outer volumes 120*b*. Also, adjacent outer volumes 120*b* communicate only via openings 121 along the length of the flash hider 100. In other embodiments, fewer flow partitions 128 can be used, such as two, three, or four. Also, other embodiments optionally define openings in some or all of the flow partitions 128 to permit communication between adjacent outer volumes 120*b*.

Figure 11A:
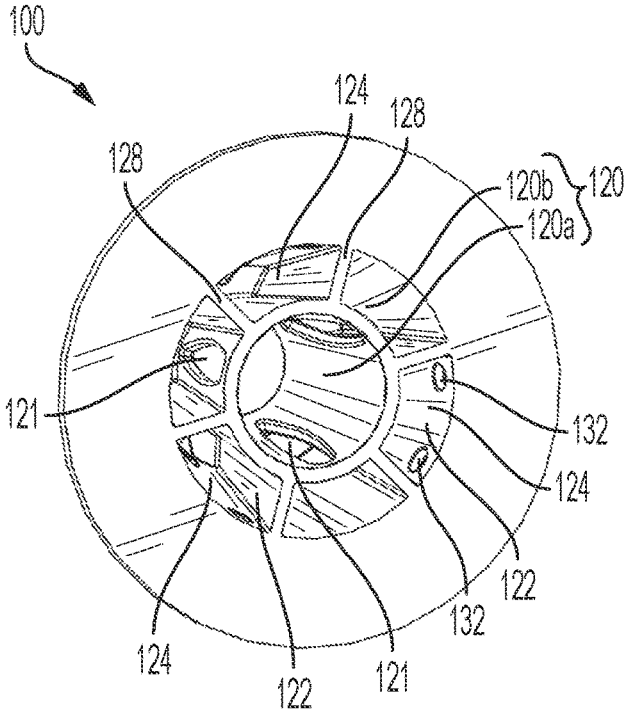
FIGS. 11A-11D illustrate a front perspective view, a rear perspective view, a front view, and a side view, respectively, of a flash hider having a first flash hider portion and a second flash hider portion, where the first flash hider portion includes an inner volume and a plurality of outer volumes, and where the second flash hider portion includes radially outer volumes interspersed circumferentially with outer volumes of the first flash hider portion, in accordance with an embodiment of the present disclosure.
Figure 11B:
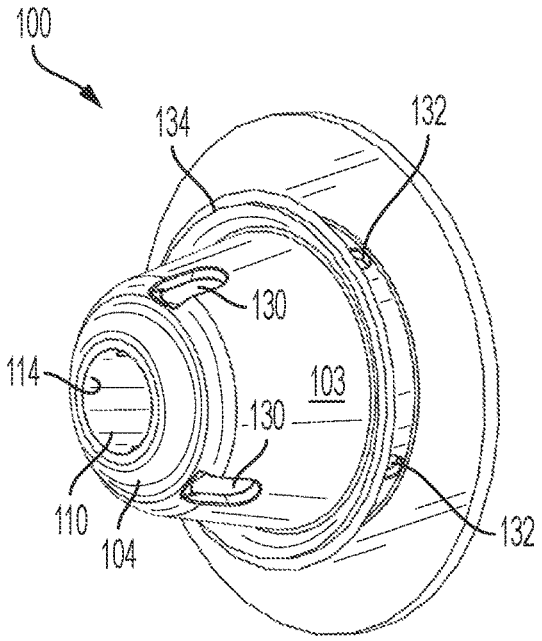
Figure 11C:
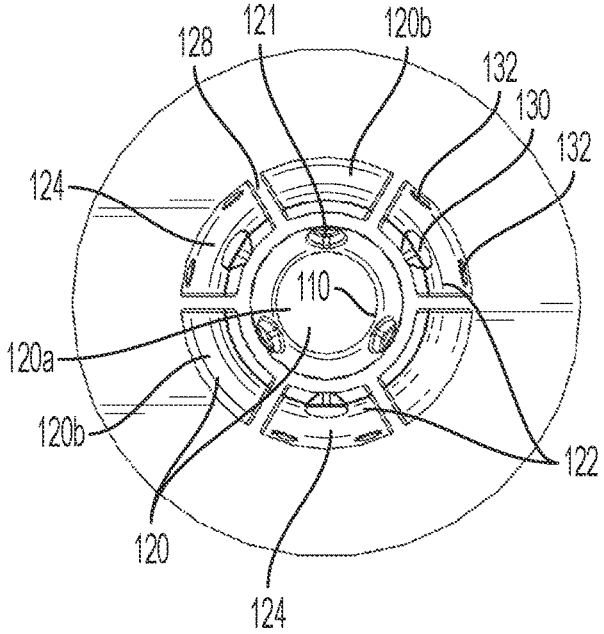
Figure 11D:
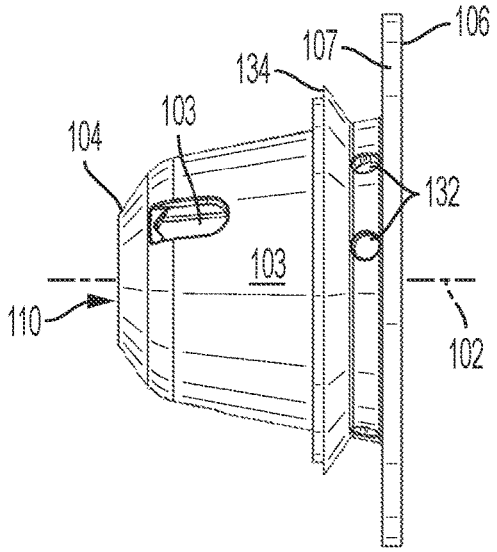

Referring now to FIGS. 11A-1D, various views illustrate a flash hider 100 having a first flash hider portion 120 and a second flash hider portion 122, in accordance with another embodiment of the present disclosure. FIG. 11A shows a front perspective view, FIG. 11B shows a rear perspective view, FIG. 11C shows a front-end view, and FIG. 11D shows a side view. This embodiment is similar to that of FIGS. 9A-9D and 10A-10*d* in that it includes an inner wall 114 arranged coaxially within and connected to an outer wall 103 at the proximal end 104 of the flash hider 100. In this embodiment, the first flash hider portion 120 includes an inner volume 120*a* inside of the inner wall 114 and a plurality of outer volumes 120*b* radially outside of the inner volume 120*a* between the inner wall 114 and the outer wall 103. The second flash hider portion 122 includes radially outer volumes 124 that are also radially between the inner wall 114 and the outer wall 103, where radially outer volumes 124 are interspersed circumferentially with outer volumes 120*b* of the first flash hider portion 120.

Flow partitions 128 extend between and connect the inner wall 114 and the outer wall 103 to divide the annular space between the inner wall 114 and the outer wall 103 into outer volumes 120*b* of the first flash hider portion 120 and radially outer volumes 124 of the second flash hider portion 122. In this embodiment, three outer volumes 120*b* of the first flash hider portion 120 are interspersed circumferentially with three radially outer volumes 124 of the second flash hider portion 122. More or fewer flow partitions 128 can be used, as will be appreciated. Each outer volume 120*b* of the first flash hider portion 120 communicates with the inner volume 120*a* via an opening 121 in the inner wall 114. However, the radially outer volumes 124 of the second flash hider portion 122 are isolated from the first flash hider portion 120 by the flow partitions 128 and inner wall 114. More specifically, the inner wall 114 lacks openings 121 in regions of the inner wall 114 that define part of a radially outer volume 124 of the second flash hider portion 122. Accordingly, the radially outer volumes 124 are isolated from the first flash hider portion 120 along the length of the flash hider 100.

Gases can enter the first flash hider portion 120 via the central opening 110 on the proximal end 104 and can expand into the inner volume 120*a* and into the outer volumes 120*b* via openings 121. Gases can enter the radially outer volumes 124 of the second flash hider portion 122 via proximal vent openings 130 in the outer wall 103. Optionally, the outer wall 103 also defines distal vent openings 132 to the radially outer volumes 124 of the second flash hider portion 122. In some such embodiments, the flash hider includes a flange 134 on the outer wall 103 that can be connected to an inner wall 204 of a suppressor assembly 200 (e.g., shown in FIG. 1D). Thus, for example, proximal vent openings 130 may provide a pathway for off-axis gases to vent through the second flash hider portion 122, where such off-axis gases may be inside of the inner wall 204 of the suppressor assembly 200. When the flange 134 and distal vent openings 132 are present, the flash hider 100 can be connected to the inner wall 204 of the suppressor assembly 200 and provide a pathway to vent gases 305 flowing through an outer chamber 210 of the suppressor assembly 200 (shown, e.g., in FIG. 1D). Providing pathways to vent gases through the second flash hider portion 122 has the effect of reducing pressure in the suppressor assembly 200, and in turn reduces gas back flow into the firearm's chamber, in accordance with some embodiments.

Figure 12:
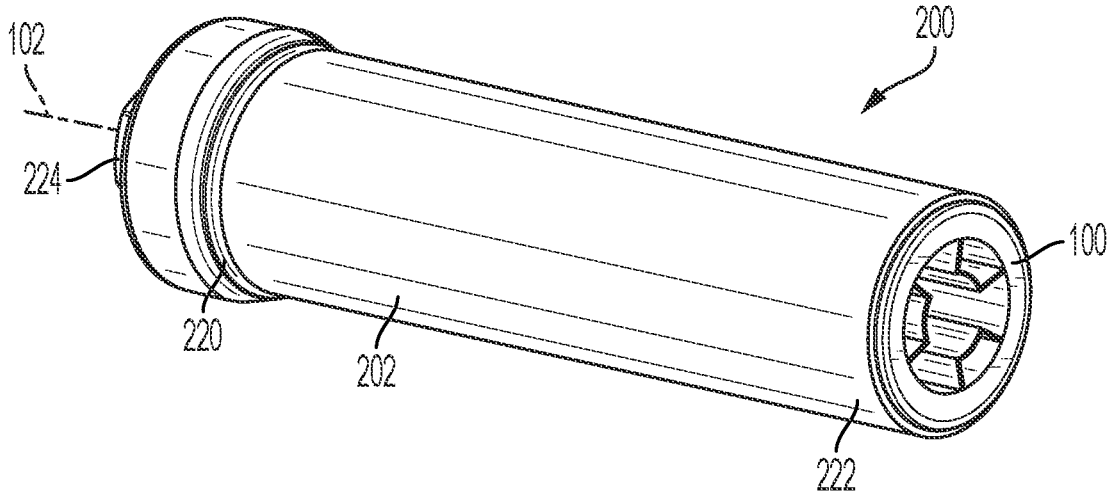
FIG. 12 illustrates a front perspective view of a suppressor that includes an integral flash hider in the distal end portion, in accordance with an embodiment of the present disclosure.

FIG. 12 illustrates a front perspective view of a suppressor assembly 200 with an flash hider 100 integral to the distal end portion 222, in accordance with an embodiment of the present disclosure. The suppressor assembly 200 extends along a central axis 102 and includes a housing 202 having a cylindrical shape that extends between a proximal end portion 220 and the distal end portion 222. In some embodiments, the flash hider 100 is made as a single structure with other components of the suppressor assembly 200, such as when made using additive manufacturing techniques. In other embodiments, the flash hider 100 can be a separate component that is welded or otherwise secured to the housing 202, for example. In this example, the proximal end portion 220 includes a mount 224 that is configured to connect to the barrel of a firearm, such as with a threaded interface. In one example, the mount 224 can be configured for direct connection to the barrel of a firearm or can be configured to receive an adapter or a quick-disconnect assembly that facilitates indirect connection of the suppressor assembly 200 to the barrel of a firearm. Other configurations of the mount 224 be apparent in light of the present disclosure. Although illustrated with one particular embodiment of the flash hider 100, the suppressor assembly 200 is not limited to any particular configuration and can include any of the embodiments of a flash hider 100 discussed above.

Further Example Embodiments

The following examples pertain to further embodiments, from which numerous permutations and configurations will be apparent.

Example 1 is a flash hider for a suppressor, the flash hider comprising a flash hider body extending along a central axis from a proximal end to a distal end, the proximal end defining a central opening, the flash hider body having an outer wall defining one or more vent openings; a first flash hider portion defining an inner volume that expands along the central axis between the proximal end and the distal end; and a second flash hider portion with one or more gas passageways radially outside of the inner volume, the gas passageways of the second flash hider portion in fluid communication with the one or more vent openings and isolated from the inner volume along an axial length of the flash hider.

Example 2 includes the subject matter of Example 1, wherein the inner volume has a frustoconical shape circumscribed in part by the gas passageways of the second flash hider portion.

Example 3 includes the subject matter of Examples 1 or 2, wherein the first flash hider portion includes a plurality of outer volumes in fluid communication with the inner volume, the plurality of outer volumes interspersed circumferentially with the plurality of gas passageways of the second flash hider portion.

Example 4 includes the subject matter of Example 3, wherein the plurality of outer volumes and the plurality of gas passageways of the second flash hider portion are distributed circumferentially along the outer wall.

Example 5 includes the subject matter of any of Examples 1-4, wherein each of the plurality of gas passageways is defined at least in part by a hollow flow partition connected to the outer wall.

Example 6 includes the subject matter of Example 5, wherein each hollow flow partition includes a radially inner wall and sides connecting the radially inner wall to the outer wall.

Example 7 includes the subject matter of Example 6, wherein sides of the flow partition extend radially towards the central axis.

Example 8 includes the subject matter of Example 7, wherein each of the plurality of gas passageways has a sector shape.

Example 9 includes the subject matter of Example 7, wherein sides of the flow partition are substantially parallel.

Example 10 includes the subject matter of any of Examples 1-9, wherein the one or more vent openings includes at least one vent opening for each of the plurality of gas passageways.

Example 11 includes the subject matter of any of Examples 1-10, wherein the one or more vent openings includes at least one proximal vent opening located closer to the proximal end and at least one distal vent opening located closer to the distal end.

Example 12 includes the subject matter of any of Examples 1-11, wherein plurality of gas passageways of the second flash hider portion includes at least three gas passageways.

Example 13 includes the subject matter of any of Examples 1-12, wherein the gas passageways of the second flash hider portion are evenly distributed circumferentially.

Example 14 includes the subject matter of any of Examples 1-13, wherein a circumferential length of each gas passageway of the second flash hider portion is greater than or equal to a circumferential width between adjacent gas passageways.

Example 15 includes the subject matter of any of Examples 1-13, wherein a circumferential length of each gas passageway of the second flash hider portion is less than a circumferential width between adjacent gas passageways.

Example 16 includes the subject matter of any of Examples 1-15, wherein each of the plurality of gas passageways spans from 30 to 80 degrees along the outer wall.

Example 17 includes the subject matter of any of Examples 1-16 and further comprises a flange on the distal end, the flange extending radially outward from the outer wall.

Example 18 includes the subject matter of Example 17, wherein the flange defines a plurality of distal vent openings.

Example 19 includes the subject matter of Example 18 and further comprises a wall extending rearwardly from a proximal face of the flange to an outside of the outer wall, the wall defining a passageway to at least one of the plurality of distal vent openings.

Example 20 includes the subject matter of Example 19, wherein the passageway has an inlet opening oriented transversely to the central axis so as to define a non-linear gas flow path to each distal vent opening.

Example 21 is a flash hider for a suppressor, the flash hider comprising a hollow flash hider body having an outer wall extending along a central axis from a proximal end to a distal end, the proximal end defining a central opening, wherein a volume of the flash hider body increases in size moving towards the distal end; and flow partitions extending into the volume from the outer wall toward the central axis, the flow partitions distributed about the central axis in a circumferentially spaced-apart arrangement, each of the flow partitions having sides and a radially inner surface; wherein the volume includes (i) an inner volume that expands along the central axis between the proximal end and the distal end, the inner volume circumscribed by the radially inner surfaces of the flow partitions, and (ii) a plurality of outer volumes located radially outside of the inner volume and continuous with the inner volume, the plurality of outer volumes interspersed circumferentially with the flow partitions.

Example 22 includes the subject matter of Example 21, wherein the outer wall follows a frustoconical shape.

Example 23 includes the subject matter of Examples 21 or 22, wherein the sides of each flow partition.

Example 24 includes the subject matter of Examples 21 or 22, wherein the sides of each flow partition extend radially from the outer wall.

Example 25 includes the subject matter of any of Examples 21-24, wherein each of the flow partitions defines a gas passageway extending therethrough generally in an axial direction, the gas passageway isolated by the flow partition from the inner volume and the outer volumes along an axial length of the flash hider.

Example 26 includes the subject matter of Example 25, wherein the gas passageway communicates with an outside of the outer wall via one or more proximal vent openings.

Example 27 includes the subject matter of Example 26, wherein the gas passageway further communicates with an outside of the outer wall via one or more distal vent openings.

Example 28 is a suppressor for a firearm, the suppressor including the flash hider of any of Examples 1-27. The suppressor comprises a suppressor housing extending along a central axis from a proximal suppressor end to a distal suppressor end, where the flash hider is secured to the suppressor housing at or near the distal suppressor end.

Example 29 includes the subject matter of Example 28, wherein the suppressor defines a central suppressor volume and a radially outer volume, the central suppressor volume configured to direct propellant gases into the central opening of the flash hider.

Example 30 includes the subject matter of Example 29, wherein the radially outer volume of the suppressor is isolated at least in part from the central suppressor volume by an inner tubular wall located within and coaxially arranged with the housing.

Example 31 includes the subject matter of Example 30, wherein the inner tubular wall is connected to the outer wall of the flash hider.

Example 32 includes the subject matter of any of Examples 28-31, wherein the flash hider is a monolithic structure with the suppressor housing.

Example 33 is a suppressor for a firearm, the suppressor comprising a tubular suppressor housing extending along a central axis from a first end to a second end; and a flash hider secured to the housing adjacent the second end, the flash hider having (a) a hollow flash hider body with an outer wall extending along the central axis from a proximal end to a distal end, the proximal end defining a central opening, a volume of the flash hider body increasing in size moving towards the distal end; and (b) flow partitions extending into the volume from the outer wall toward the central axis, the flow partitions distributed about the central axis in a circumferentially spaced-apart arrangement, each of the flow partitions having sides and a radially inner surface; wherein the volume includes (i) an inner volume that expands along the central axis between the proximal end and the distal end, the inner volume circumscribed by the radially inner surface of the flow partitions, and (ii) a plurality of outer volumes located radially outside of the inner volume and continuous with the inner volume, the plurality of outer volumes interspersed circumferentially with the flow partitions.

Example 34 includes the subject matter of Example 33, wherein at least part of the outer wall has a frustoconical shape.

Example 35 includes the subject matter of any of Examples 33-34, wherein the sides of each flow partition are substantially parallel.

Example 36 includes the subject matter of any of Examples 33-34, wherein the sides of each flow partition extend substantially in a radial direction from the outer wall.

Example 37 includes the subject matter of any of Examples 33-36, wherein each of the flow partitions defines a gas passageway isolated from the inner volume and the outer volumes along an axial length of the flash hider.

Example 38 includes the subject matter of Example 37, wherein each flow partition generally has a U shape with sides of the U connected to the outer wall.

Example 39 includes the subject matter of Examples 37 or 38 and further comprises an inner suppressor wall extending axially along an inside of the suppressor housing and coaxially arranged with the suppressor housing, wherein the suppressor defines an inner suppressor volume within the inner suppressor wall and an outer suppressor volume between the suppressor housing and the inner suppressor wall.

Example 40 includes the subject matter of Example 39, wherein the tubular suppressor housing is connected to the distal end of the flash hider and wherein the inner suppressor wall is connected to the outer wall of the flash hider.

Example 41 includes the subject matter of any of Examples 37-40, wherein the gas passageway has a proximal end portion in fluid communication with the outer suppressor volume via a proximal vent opening.

Example 42 includes the subject matter of Example 41, wherein the gas passageway further communicates with the outer suppressor volume via one or more distal vent openings.

Example 43 includes the subject matter of any of Examples 33-42, wherein the flash hider is a monolithic structure with the tubular suppressor housing.

Example 44 is a suppressor for a firearm, the suppressor comprising a suppressor housing extending along a central axis from a first end to a second end; and a flash hider secured to the second end of the suppressor housing. The flash hider comprises a flash hider body extending along the central axis from a proximal end to a distal end, the proximal end defining a central opening, the flash hider body having an outer wall defining one or more vent openings; a first flash hider portion defining a central volume that expands along the central axis between the proximal end and the distal end; and a second flash hider portion including a plurality of gas passageways radially outside of the central volume, the plurality of gas passageways in fluid communication with the one or more vent openings and isolated from the central volume.

Example 45 includes the subject matter of Example 44, wherein the first end of the suppressor housing is configured to attach to a barrel of a firearm.

Example 46 includes the subject matter of Examples 44 or 45 and further comprises an inner suppressor wall extending axially along an inside of the suppressor housing and coaxially arranged with the suppressor housing, wherein the suppressor defines an inner suppressor volume within the inner suppressor wall and an outer suppressor volume between the suppressor housing and the inner suppressor wall.

Example 47 includes the subject matter of any of Examples 44-46, wherein the central volume has a frustoconical shape defined in part by the gas passageways of the second flash hider portion.

Example 48 includes the subject matter of any of Examples 44-47, wherein the first flash hider portion includes a plurality of outer volumes that are continuous with the central volume, the plurality of outer volumes interspersed circumferentially with the plurality of gas passageways of the second flash hider portion.

Example 49 includes the subject matter of Example 48, wherein the plurality of outer volumes and the plurality of gas passageways of the second flash hider portion are distributed circumferentially along the outer wall.

Example 50 includes the subject matter of any of Examples 44-49, wherein each of the plurality of gas passageways is defined at least in part by a flow partition connected to the outer wall.

Example 51 includes the subject matter of Example 50, wherein the flow partition generally has a U shape with ends of the U connected to an inside of the outer wall.

Example 52 includes the subject matter of Examples 50 or 51, wherein sides of the flow partition extend radially towards the central axis.

Example 53 includes the subject matter of Example 52, wherein each of the plurality of gas passageways has a sector shape.

Example 54 includes the subject matter of Example 51, wherein sides of the flow partition are substantially parallel.

Example 55 includes the subject matter of any of Examples 44-54, wherein the one or more vent openings includes at least one vent opening for each of the plurality of gas passageways.

Example 56 includes the subject matter of any of Examples 44-55, wherein the one or more vent openings includes at least one proximal vent opening located closer to the proximal end and at least one distal vent opening located closer to the distal end.

Example 57 includes the subject matter of any of Examples 44-56, wherein plurality of gas passageways of the second flash hider portion includes at least three gas passageways.

Example 58 includes the subject matter of any of Examples 44-57, wherein the gas passageways of the second flash hider portion are evenly distributed circumferentially.

Example 59 includes the subject matter of any of Examples 44-58, wherein a circumferential length of each of the plurality of gas passageways of the second flash hider portion is greater than or equal to a circumferential width between adjacent gas passageways.

Example 60 includes the subject matter of any of Examples 44-58, wherein a circumferential length of each of the plurality of gas passageway of the second flash hider portion is less than a circumferential width between adjacent gas passageways.

Example 61 includes the subject matter of any of Examples 44-60, wherein each of the plurality of gas passageways spans from 30 to 80 degrees along the outer wall.

Example 62 includes the subject matter of any of Examples 44-61 and further comprises a flange on the distal end of the flash hider, the flange extending radially outward from the outer wall to the suppressor housing.

Example 63 includes the subject matter of Example 62, wherein the flange defines a plurality of distal vent openings.

Example 64 includes the subject matter of Example 63 and further comprises a wall extending rearwardly from the flange and defining a passageway to at least one of the plurality of distal vent openings, the passageway having an inlet opening.

Example 65 includes the subject matter of Example 64, wherein the inlet opening is directed transversely to the central axis.

Example 66 includes the subject matter of any of Examples 44-65, wherein the flash hider is a monolithic structure with the suppressor housing.

Example 67 is a flash hider for a suppressor, the flash hider comprising a flash hider body extending along a central axis from proximal end to a distal end, the flash hider body including a first wall having an annular shape that expands in volume towards the distal end; and a second wall connected to the proximal end of the flash hider body, the second wall having an annular shape that is coaxially arranged within the first wall and that expands in volume towards the distal end, the second wall defining a plurality of openings. The flash hider body defines one or more outer volumes between the second wall and the first wall, and the first wall defines an inner volume in communication with the one or more outer volumes via the plurality of openings. In one example, the outer volume is a single, uninterrupted outer volume that surrounds the inner volume.

Example 68 includes the subject matter of Example 67 and further comprises a plurality of flow partitions extending between and connecting the first wall and the second wall, the plurality of flow partitions distributed about the central axis in a circumferentially spaced-apart arrangement. The flow partitions can divide the region between the first and second walls into a plurality of outer volumes, where at least some of the outer volumes communicate with the inner volume via the openings in the second wall.

Example 69 includes the subject matter of Example 68, wherein each of the plurality of flow partitions extends radially between the first wall and the second wall.

Example 70 includes the subject matter of any of Examples 67-69, wherein at least one of the first wall and the second wall has a frustoconical shape.

Example 71 includes the subject matter of any of Examples 67-70, wherein inner volume and the outer volumes are part of a first flash hider portion, and the flash hider body further defines a second flash hider portion including a plurality of radially outer volumes interspersed circumferentially with the outer volumes of the first flash hider portion. The first wall is an outer wall that defines at least one vent opening in communication with each radially outer volume of the second flash hider portion. The first flash hider portion is isolated from the second flash hider portion along a length of the flash hider body.

Example 72 includes the subject matter of Example 71, wherein the at least one vent opening includes one or more proximal vent openings and one or more distal vent openings.

Example 73 includes the subject matter of Example 72 and further comprises a flange extending outward from an outside of the first wall.

Example 74 is a suppressor for a firearm, the suppressor comprising a tubular suppressor housing extending along a central axis from a first end to a second end; and a flash hider secured to the housing adjacent the second end, the flash hider having (i) a flash hider body extending along a central axis from proximal end to a distal end, the flash hider body including a first wall having an annular shape that expands in volume towards the distal end, and (ii) a second wall connected to the proximal end of the flash hider body, the second wall having an annular shape that is coaxially arranged within the first wall and that expands in volume towards the distal end, the second wall defining a plurality of openings; wherein the flash hider body defines one or more outer volumes between the second wall and the first wall, and the first wall defines an inner volume in communication with the one or more outer volumes via the plurality of openings.

Example 75 includes the subject matter of Example 74 and further comprises a plurality of flow partitions extending between and connecting the first wall and the second wall, the plurality of flow partitions distributed about the central axis in a circumferentially spaced-apart arrangement.

Example 76 includes the subject matter of Example 75, wherein each of the plurality of flow partitions extends radially between the first wall and the second wall.

Example 77 includes the subject matter of any of Examples 74-76, wherein at least one of the first wall and the second wall has a frustoconical shape.

Example 78 includes the subject matter of any of Examples 74-77 wherein inner volume and the outer volumes are part of a first flash hider portion, the flash hider body further defining a second flash hider portion including a plurality of radially outer volumes interspersed circumferentially with the outer volumes of the first flash hider portion; wherein the outer wall defines at least one vent opening in communication with each radially outer volume of the second flash hider portion; and wherein the first flash hider portion is isolated from the second flash hider portion along a length of the flash hider body.

Example 79 includes the subject matter of Example 78, wherein the at least one vent opening includes one or more proximal vent openings and one or more distal vent openings.

Example 80 includes the subject matter of Example 79 and further comprises a flange on an outside of the first wall.

Example 81 includes the subject matter of Example 80 and further comprises an inner suppressor wall extending axially along an inside of the suppressor housing and coaxially arranged with the suppressor housing, wherein the suppressor defines an inner suppressor volume inside of the inner suppressor wall and an outer suppressor volume between the suppressor housing and the inner suppressor wall.

Example 82 includes the subject matter of Example 81, wherein the tubular suppressor housing is connected to the distal end of the flash hider and wherein the inner suppressor wall is connected to the flange on the first wall of the flash hider.

Example 83 includes the subject matter of any of Examples 74-82, wherein the flash hider is a monolithic structure with the tubular suppressor housing.

The foregoing description of the embodiments of the disclosure has been presented for the purpose of illustration; it is not intended to be exhaustive or to limit the claims to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the invention, which is set forth in the following claims.

What is claimed is:

1. A flash hider for a suppressor, the flash hider comprising:

an outer wall with an expanding annular shape extending along a central axis from a proximal end defining a central opening to a distal end, the outer wall defining vent openings between the proximal end and the distal end;

a first flash hider portion in communication with the central opening and defining an inner volume that expands along the central axis between the proximal end and the distal end; and a second flash hider portion with two or more gas passageways radially outside of the inner volume, the two or more gas passageways in fluid communication with the vent openings, wherein the second flash hider portion is isolated from first flash hider portion along an axial length of the flash hider;

wherein the first flash hider portion includes a plurality of outer volumes in fluid communication with the inner volume, and wherein outer volumes of the plurality of outer volumes are interspersed circumferentially with the gas passageways of the second flash hider portion.

2. The flash hider of claim 1, wherein the one or more vent openings includes at least one proximal vent opening located adjacent the proximal end, and at least one distal vent opening located adjacent the distal end.

3. The flash hider of claim 1, further comprising a flange on the distal end, the flange extending radially outward from the outer wall and defining a plurality of distal vent openings.

4. The flash hider of claim 3 further comprising a wall extending from a proximal face of the flange to an outside of the outer wall, the wall defining an entrance to at least one of the vent openings, wherein the entrance is oriented transversely to the central axis.

5. The flash hider of claim 1, further comprising:

hollow flow partitions extending inward from the outer wall, each of the hollow flow partitions including a radially inner wall and sides connecting the radially inner wall to the outer wall, the hollow flow partitions defining the one or more gas passageways;

wherein each radially inner wall partially defines the inner volume; and wherein adjacent partitions of the plurality of hollow flow partitions are circumferentially spaced apart so as to define an outer volume between adjacent partitions, each outer volume radially outside of the inner volume and in fluid communication with the inner volume, wherein the first flash hider portion includes the inner volume and each outer volume.

6. The flash hider of claim 5, wherein sides of each hollow flow partition extend radially inward towards the central axis.

7. The flash hider of claim 5, wherein sides of each flow partition are substantially parallel.

8. The flash hider of claim 5, wherein the outer wall has a frustoconical shape.

9. The flash hider of claim 5 further comprising a circumferential wall segment extending circumferentially between and connecting sides of adjacent flow partitions.

10. The flash hider of claim 9, wherein the circumferential wall segment connects to the sides of adjacent flow partitions at a location radially between the outer wall and the radially inner wall, and wherein an additional radially outer volume is defined radially between the circumferential wall and the outer wall and circumferentially between the adjacent flow partitions, each additional radially outer volume in fluid communication with at least one of the vent openings in the outer wall.

11. The flash hider of claim 9, wherein the radially inner wall of each of the plurality of hollow flow partitions and the circumferential wall segments together define an annular inner wall, and wherein each outer volume communicates with the inner volume via an opening in the annular inner wall.

12. A flash hider for a suppressor, the flash hider comprising:

a flash hider body having an outer wall extending along a central axis from a proximal end to a distal end, the proximal end defining a central opening, wherein a volume of the flash hider body increases in size moving towards the distal end; and flow partitions extending inward from the outer wall toward the central axis, the flow partitions distributed about the central axis in a circumferentially spaced-apart arrangement, wherein each of the flow partitions has a radially inner wall and sides connecting the radially inner wall to the outer wall, wherein each of the flow partitions is hollow so as to define a gas passageway to the distal end, the gas passageway located between the outer wall, the radially inner wall and the sides of the flow partition, and wherein the outer wall defines one or more vent openings in communication with each gas passageway;

wherein the volume of the flash hider body includes (i) an inner volume that expands along the central axis between the proximal end and the distal end, the inner volume bounded in part by the radially inner wall of each of the flow partitions, and (ii) a plurality of outer volumes located radially outside of the inner volume and continuous with the inner volume, the plurality of outer volumes interspersed circumferentially with the flow partitions; and wherein the gas passageway of each of the flow partitions is isolated from the inner volume and from the outer volumes along an axial length of the flash hider.

13. The flash hider of claim 12, wherein the outer wall has a frustoconical shape.

14. The flash hider of claim 12, wherein the sides of each flow partition are substantially parallel.

15. The flash hider of claim 12, wherein the sides of each flow partition extend radially inward from the outer wall towards the central axis.

16. A flash hider for a suppressor, the flash hider comprising:

a flash hider body extending along a central axis from proximal end to a distal end, the flash hider body including a first wall having an annular shape that expands in volume towards the distal end; and a second wall connected to the proximal end of the flash hider body, the second wall having an annular shape that is coaxially arranged within the first wall and that expands in volume towards the distal end, the second wall defining a plurality of openings;

wherein the flash hider body defines one or more outer volumes between the first wall and the second wall and defines an inner volume inside of the second wall, the inner volume in communication with the one or more outer volumes via the plurality of openings, wherein the inner volume and the one or more outer volumes are part of a first flash hider portion; and wherein the flash hider body further defines a second flash hider portion including a plurality of radially outer volumes interspersed circumferentially with the outer volumes of the first flash hider portion.

17. The flash hider of claim 16, wherein at least one of the first wall and the second wall has a frustoconical shape.

18. The flash hider of claim 16 further comprising partitions extending radially between and connecting the first wall and the second wall.

* * * * *